US008337664B2

(12) United States Patent
Cunningham et al.

(10) Patent No.: US 8,337,664 B2
(45) Date of Patent: Dec. 25, 2012

(54) METHOD AND APPARATUS FOR MAKING SLIT-BANDED WRAPPER USING MOVING ORIFICES

(75) Inventors: John F. Cunningham, Richmond, VA (US); Marc W. Rose, Mechanicsville, VA (US); Thomas A. Fletcher, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 951 days.

(21) Appl. No.: 12/346,447

(22) Filed: Dec. 30, 2008

(65) Prior Publication Data

US 2009/0277466 A1 Nov. 12, 2009

Related U.S. Application Data

(60) Provisional application No. 61/006,200, filed on Dec. 31, 2007.

(51) Int. Cl.
*D21H 19/66* (2006.01)
*D21H 19/68* (2006.01)

(52) U.S. Cl. ..... 162/139; 162/135; 131/365; 118/323; 118/324; 118/325; 118/315

(58) Field of Classification Search ..... None
See application file for complete search history.

(56) References Cited

U.S. PATENT DOCUMENTS 205,312 A 6/1878 Steele
746,786 A 12/1903 Burdick
1,214,658 A 2/1917 Dun Lany
(Continued)

FOREIGN PATENT DOCUMENTS

BE 570440 9/1958
(Continued)

OTHER PUBLICATIONS

International Preliminary Report on Patentability issued Jul. 6, 2010 for PCT/IB2008/003735.

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

A method and apparatus of manufacturing a web which is striped with add-on material, comprising: a first slurry supply which forms a sheet of base web and moves the sheet along a first path; a second slurry supply; and a moving orifice applicator operative so as to repetitively discharge the second slurry upon the moving sheet of base web. The moving orifice applicator includes a chamber box arranged to establish a reservoir of the second slurry across the first path, an endless belt having orifice groups, the endless belt received through the chamber box, and a drive arrangement operative upon the endless belt to continuously move the orifices along an endless-path and repetitively through the chamber box. The orifices communicate with the reservoir to discharge the second slurry as bands of add-on material to the base web. Orifices within the orifice groups can be spaced relative to one another to define bands of add-on material having a relative minimum in thickness or to define spaced apart bands. Orifices may also cooperate with a stationary or moving template to define segmented bands having gaps with complex edges. The web resulting from the method or the apparatus may be used for a smoking article. A smoking article may be constructed from wrapper made with the apparatus or the method.

10 Claims, 24 Drawing Sheets

U.S. PATENT DOCUMENTS

| | | | | | |
|---|---|---|---|---|---|
| 1,214,659 | A | | 2/1917 | Dun Lany | |
| 1,513,969 | A | | 11/1924 | Cumfer et al. | |
| 1,555,320 | A | | 9/1925 | Weil | |
| 1,787,218 | A | | 12/1930 | Trask | |
| 1,847,269 | A | | 3/1932 | Schur | |
| 1,903,236 | A | | 2/1933 | Johnsen | |
| 1,996,002 | A | | 3/1935 | Seaman | |
| 1,999,222 | A | | 4/1935 | Weinberger | |
| 2,013,508 | A | | 9/1935 | Seaman | |
| 2,029,273 | A | | 1/1936 | Montgomery et al. | |
| 2,049,320 | A | | 7/1936 | Ruben et al. | |
| 2,112,540 | A | | 3/1938 | McAndrews et al. | |
| 2,426,043 | A | | 8/1947 | Muggleton | |
| 2,666,437 | A | | 1/1954 | Lattof | |
| 2,711,120 | A | | 6/1955 | MacLaurin | |
| 2,904,448 | A | | 9/1959 | Sorg | |
| 3,084,661 | A | | 4/1963 | Roberts | |
| 3,090,351 | A | | 5/1963 | Coyne | |
| 3,287,207 | A | | 11/1966 | Treat | |
| 3,436,245 | A | | 4/1969 | Grundman | |
| 3,477,440 | A | | 11/1969 | Licis | |
| 3,536,580 | A | | 10/1970 | Fave | |
| 3,560,334 | A | | 2/1971 | Arledter | |
| 3,627,630 | A | | 12/1971 | Gagnon | |
| 3,632,384 | A | | 1/1972 | Saint-Pastou | |
| 3,633,536 | A | | 1/1972 | Morrison | |
| 3,633,589 | A | | 1/1972 | Kahane | |
| 3,687,274 | A | | 8/1972 | Clark et al. | |
| 3,705,821 | A | | 12/1972 | Breer et al. | |
| 3,722,515 | A | * | 3/1973 | Reynolds et al. | 131/336 |
| 3,895,603 | A | | 7/1975 | Barouh et al. | |
| 3,915,176 | A | | 10/1975 | Heitmann et al. | |
| 3,921,793 | A | | 11/1975 | Hutchinson | |
| 3,923,151 | A | | 12/1975 | Weber | |
| 3,961,755 | A | | 6/1976 | Morine et al. | |
| 4,153,503 | A | | 5/1979 | Booth et al. | |
| 4,239,591 | A | | 12/1980 | Blake | |
| 4,305,169 | A | | 12/1981 | Vidalis | |
| 4,319,524 | A | | 3/1982 | Dunham et al. | |
| 4,387,123 | A | | 6/1983 | Wollam et al. | |
| 4,400,423 | A | | 8/1983 | Scher et al. | |
| 4,489,738 | A | | 12/1984 | Simon | |
| 4,583,486 | A | | 4/1986 | Miller | |
| 4,739,775 | A | | 4/1988 | Hampl, Jr. | |
| 4,800,102 | A | * | 1/1989 | Takada | 427/197 |
| 4,861,427 | A | | 8/1989 | Johnson et al. | |
| 4,928,715 | A | | 5/1990 | Mentzel et al. | |
| 4,945,932 | A | | 8/1990 | Mentzel et al. | |
| 4,952,278 | A | | 8/1990 | Gregory et al. | |
| 4,968,534 | A | | 11/1990 | Bogardy | |
| 4,987,940 | A | | 1/1991 | Straub et al. | |
| 5,028,224 | A | | 7/1991 | Pieper et al. | |
| 5,174,435 | A | | 12/1992 | Dorner et al. | |
| 5,263,999 | A | | 11/1993 | Baldwin et al. | |
| 5,332,472 | A | | 7/1994 | Cutright et al. | |
| 5,417,228 | A | * | 5/1995 | Baldwin et al. | 131/349 |
| 5,474,095 | A | | 12/1995 | Allen et al. | |
| 5,534,114 | A | | 7/1996 | Cutright et al. | |
| 5,966,218 | A | | 10/1999 | Bokelman et al. | |
| 5,997,691 | A | | 12/1999 | Gautam et al. | |
| 6,020,969 | A | | 2/2000 | Struckhoff et al. | |
| 6,198,537 | B1 | | 3/2001 | Bokelman et al. | |
| 6,596,125 | B2 | | 7/2003 | Garg et al. | |

FOREIGN PATENT DOCUMENTS

| | | | |
|---|---|---|---|
| CH | 615 090 | A5 | 1/1980 |
| DE | 1956906 | | 6/1970 |
| EP | 0 139 934 | A1 | 5/1985 |
| EP | 0 262 550 | A1 | 4/1988 |
| EP | 0 407022 | A2 | 1/1991 |
| EP | 486213 | A1 | 5/1992 |
| EP | 532193 | A1 | 3/1993 |
| EP | 559453 | A1 | 9/1993 |
| FR | 1549596 | | 12/1968 |
| GB | 246873 | | 4/1925 |
| GB | 1 235 692 | | 6/1971 |
| JP | 51-15065 | | 5/1976 |
| JP | 51-19850 | | 6/1976 |
| SU | 895537 | | 1/1982 |

OTHER PUBLICATIONS

"Pulp Technology and Treatment for Paper," 1985, p. 595, Second Edition, James D'A. Clark, Miller Freeman Publications, Inc., San Francisco, CA.

Casey, "Pulp and Paper Chemistry and Chemical Technology," 1981, pp. 1751-1756, vol. III, 3rd Edition.

International Search Report and Written Opinion dated Jun. 29, 2009 for PCT/IB2008/003735.

* cited by examiner

METHOD AND APPARATUS FOR MAKING SLIT-BANDED WRAPPER USING MOVING ORIFICES

CROSS-REFERENCE TO RELATED APPLICATION

This application claims priority under 35 U.S.C. §119 to U.S. Provisional Application No. 61/006,200 entitled METHOD AND APPARATUS FOR MAKING SLIT-BANDED WRAPPER USING MOVING ORIFICES, filed Dec. 31, 2007, the entire content of which is hereby incorporated by reference.

FIELD OF DISCLOSURE

The present disclosure relates to method and apparatus for applying a predetermined pattern of add-on material to a base web, preferably in the form of stripes having varying thickness or multiple, parallel stripes in groups spaced along the base web. More particularly, the disclosure concerns a method and apparatus for producing cigarettes papers having banded regions of such add-on or additional material.

BACKGROUND AND CIRCUMSTANCES OF THE DISCLOSURE

Techniques have been developed for printing or coating paper webs with patterns of additional material. These prior techniques have included printing with gravure presses, blade coating, roller coating, silkscreening and stenciling.

U.S. Pat. No. 4,968,534 to Bogardy describes a stenciling apparatus wherein a continuous stencil comes into intimate contact with a paper web during application of an ink or the like. The apparatus includes an arrangement which draws air through the stencil prior to the application of the ink. The mechanical arrangement is such that to change the pattern, the stencil must be changed. Additionally, such apparatus are unworkable at the wet-end of paper-making machines.

In the related, commonly assigned U.S. Pat. No. 5,534,114, an embodiment of a moving orifice applicator is disclosed which includes an elongate "cavity block" or chamber and a perforated endless belt whose lower traverse passes along the bottom portion of the chamber. The chamber is positioned obliquely across a web-forming device (such as a Fourdrinier wire). In operation, a slurry of additional material is continuously supplied to the chamber as the endless belt is looped through the bottom portion of the chamber such that plural streams of material are generated from beneath the chamber to impinge the web passing beneath the chamber. As a result, bands of additional material are applied repetitively to the web. The orientation, width, thickness and spacing of the bands are all determinable by the relative speed and orientation of the endless belt to the moving web.

Preferably, the pattern of additional material is applied as uniformly as possible so as to render consistent product across the entire span of the web. Commonly assigned U.S. Pat. No. 5,997,691 discloses a slurry applicator which can be used with Fourdrinier machines having a width of 10 to 20 feet or more.

In the cigarette papermaking art, it is conventional to convey the sheet of paper on a Fourdrinier papermaking machine at speeds of 1200 to 1400 feet/minute. In contrast, in making sheet paper such as wrapping paper, writing paper and the like, the machine is run at speeds of about 2500 feet/minute. Specialty paper is run at slower speeds. Banded paper such as that described in commonly owned U.S. Pat. Nos. 5,417,228; 5,474,095; and 5,534,114 (see also commonly owned European Pat. Publication Nos. 486213 A1, 532193 A1 and 559453 A1), the disclosures of which including characteristics of the banded paper and papermaking techniques are hereby incorporated by reference, has been produced at speeds of 400 to 600 feet/minute. In practice, banded cigarette paper having 5 to 6 mm wide bands of add-on slurry material has been produced on a Fourdrinier machine at speeds of about 500 feet/minute using a moving orifice device wherein the belt has 3/32 inch diameter round holes. It has been discovered that when the speed of the paper sheet is increased, the band widths increase due to the high speed and higher stock flow of the material used to create the bands. It has also been discovered that reduction in stock flow for purposes of reducing band width results in lowered add-on weight of the banded regions. In order to increase production output, it would be desirable to provide a moving orifice applicator which achieves a desired band width and add-on weight at high production speeds.

SUMMARY OF DISCLOSURE

These and other objects are achieved with the present disclosure whose aspects include a method and apparatus for the production of a web having banded regions of add-on material, more particularly a cigarette paper having stripes of additional cellulosic material added thereto. A preferred method includes the steps of establishing a first slurry, and preparing a base web by laying the first slurry into a sheet form while moving the base web sheet along a first path. The method further comprises the steps of preparing a second slurry and repetitively discharging the second slurry so as to establish stripes upon the base web. The last step itself includes the steps of establishing a reservoir of the second slurry across the first path, moving a belt having orifice groups along an endless path, which path includes an endless path portion along the reservoir where the orifices are communicated with the reservoir, and discharging the second slurry from the reservoir through the orifices onto the laid first slurry. Moreover, the last step includes using a novel band having orifices configured to discharge the second slurry such that (i) groups of parallel stripes are formed on the first slurry, or (ii) the thickness of a single stripes formed on the first slurry exhibit a relative minimum value between the outer edges of the single stripe.

By introducing a base plate having transverse bars located between the moving orifice band and the moving web, the method can generate stripes having periodically spaced breaks, gaps, or slits which are distributed in the transverse direction of the web. By arranging the base plate so that it too moves relative to the underlying moving web as well as the moving orifices, the method provides breaks, gaps, or slits in locations transversely on the moving web that are displaced from the breaks, gaps, or slits of adjacent strips. Further, the generally parallel breaks, gaps, or slits can be configured as desired by selecting the shape of the orifice, the speed of the base plate, and the shape of openings in the base plate. That shape selection can generate, for example and without limitation, edges aligned with the longitudinal direction of the moving web, edges inclined relative to the longitudinal direction of the moving web, edges with symmetric points directed transversely of the moving web, edges with asymmetric points directed transversely of the moving web, or edges with generally parallel curved shapes.

The process and apparatus may be used to construct wrapper paper that may be used in manufacture of smoking devices having desired ignition propensity characteristics, and in which banded regions are fabricated from the same material as the base web or paper.

BRIEF DESCRIPTION OF THE DRAWINGS

Many objects and advantages of this disclosure will be apparent to those skilled in the art when this specification is read in conjunction with the drawings wherein like reference numerals are applied to like elements and wherein.

DETAILED DESCRIPTION OF THE PREFERRED EMBODIMENTS

Figure 1A:
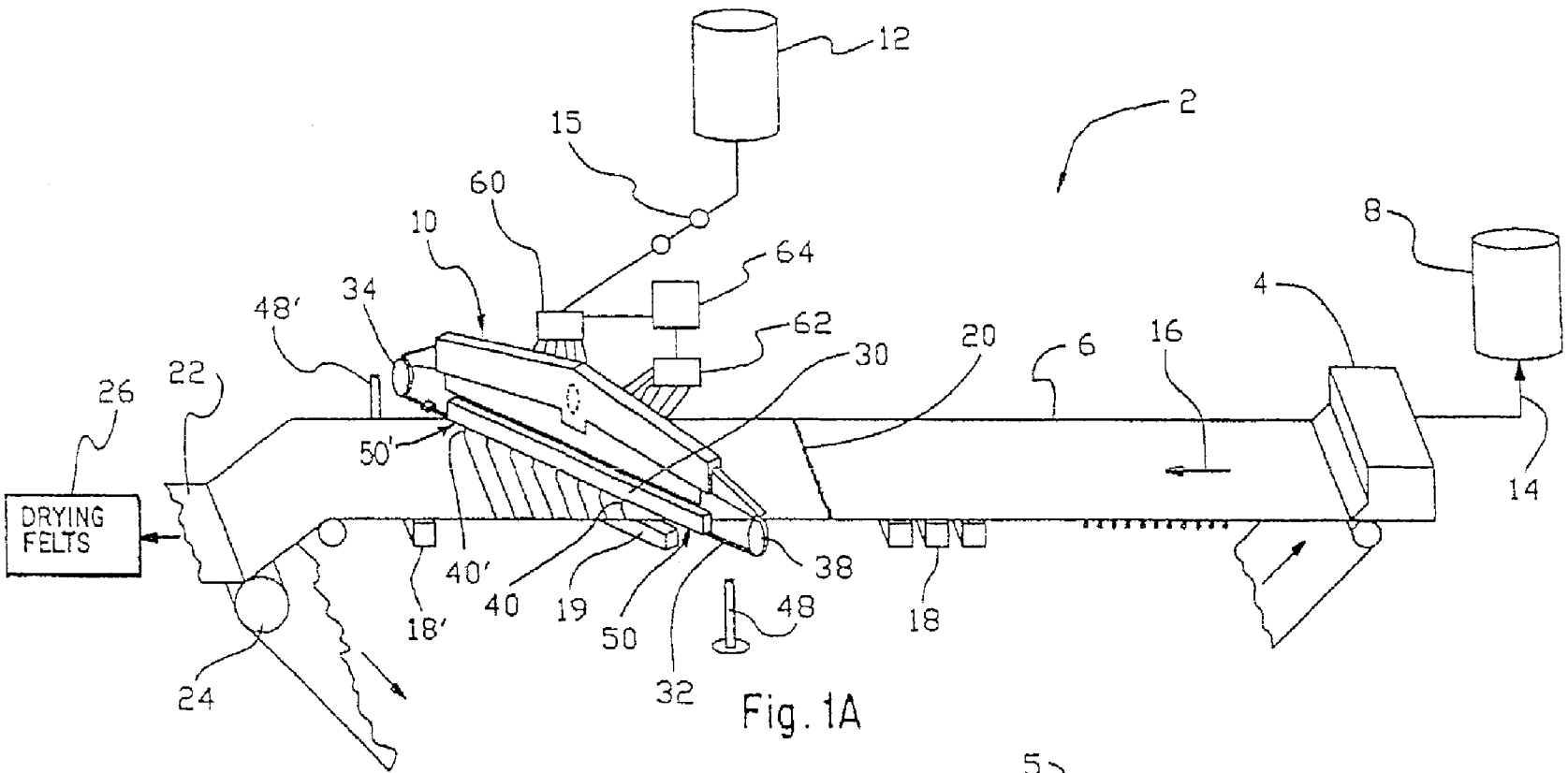
FIG. 1A is a perspective of a paper making machine constructed in accordance with a preferred embodiment of the present disclosure.

Referring to FIG. 1A, a preferred embodiment of the present disclosure comprises a cigarette paper making machine 2, which preferably includes a head box 4 operatively located at one end of a Fourdrinier wire 6, a source of feed stock slurry such as a run tank 8 in communication with the head box 4, and a moving orifice applicator 10 in operative communication with another source of slurry such as a day tank 12.

The head box 4 can be one typically utilized in the paper making industry for laying down cellulosic pulp upon the Fourdrinier wire 6. In the usual context, the head box 4 is communicated to the run tank 8 through a plurality of conduits 14. Preferably, the feed stock from the run tank 8 is a refined cellulosic pulp such as a refined flax or wood pulp as is the common practice in the cigarette paper making industry.

The Fourdrinier wire 6 carries the laid slurry pulp from the head box 4 along a path in the general direction of arrow 16 in FIG. 1A, whereupon water is allowed to drain from the pulp through the wire 6 by the influence of gravity and at some locations with the assistance of vacuum boxes 18 at various locations along the Fourdrinier wire 6 as is the established practice in the art of cigarette paper making. At some point along the Fourdrinier wire 67 sufficient water is removed from the base web pulp to establish what is commonly referred to as a dry line 20 where the texture of the slurry transforms from one of a glossy, watery appearance to a surface appearance more approximating that of the finished base web (but in a wetted condition). At and about the dry line 20, the moisture content of the pulp material is approximately 85 to 90%, which may vary depending upon operating conditions and the like.

Downstream of the dry line 20, the base web 22 separates from the Fourdrinier wire 6 at a couch roll 24. From there, the Fourdrinier wire 6 continues on the return loop of its endless path. Beyond the couch roll 24, the base web 22 continues on through the remainder of the paper making system which further dries and presses the base web 22 and surface conditions it to a desired final moisture content and texture. Such drying apparatus are well known in the art of paper making and may include drying felts 26 and the like.

Figure 2:
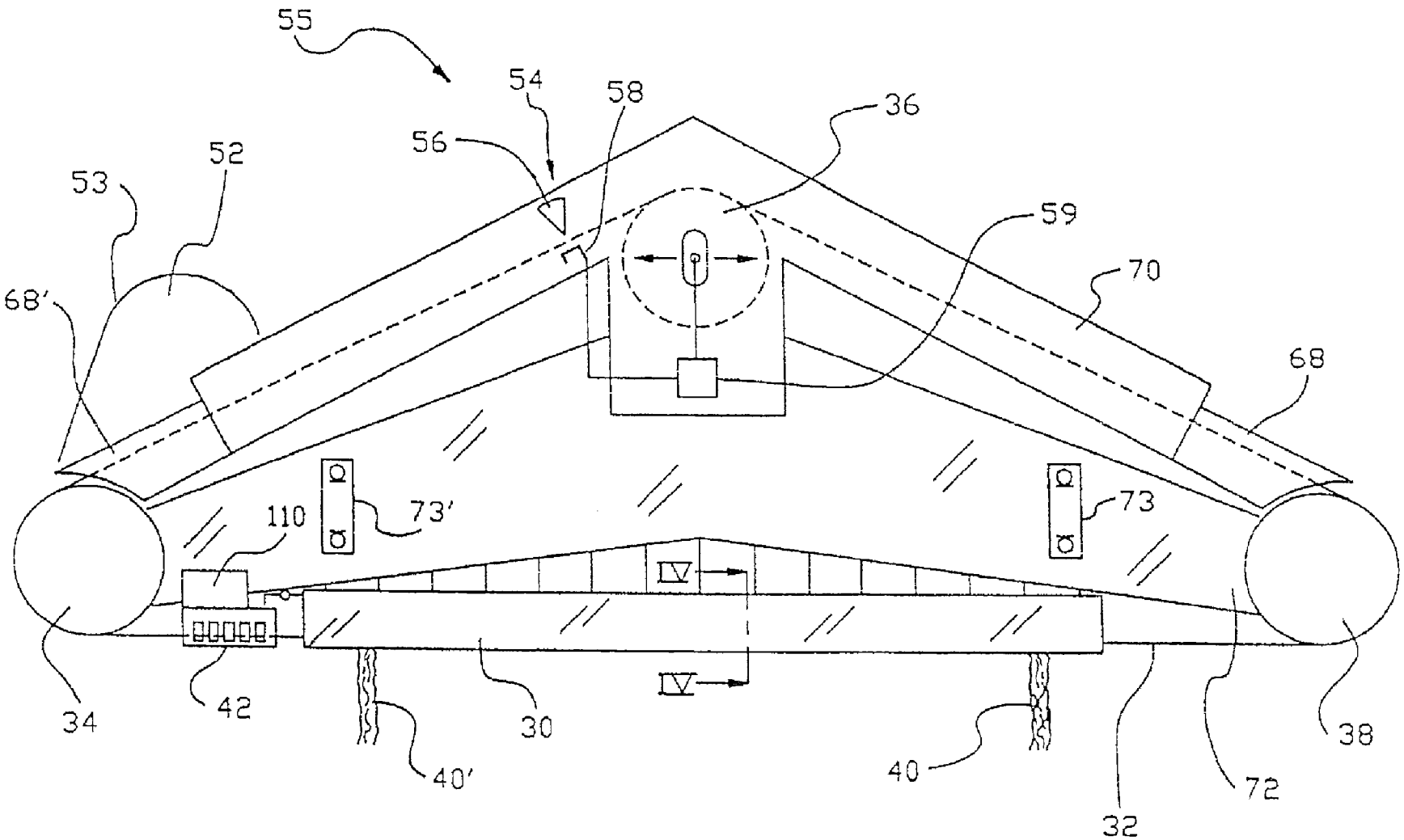
FIG. 2 is a side view of the moving orifice applicator constructed in accordance with a preferred embodiment of the present disclosure.

Referring now to both FIGS. 1A and 2, the moving orifice applicator 10 preferably comprises an elongate chamber box 30 for establishing a reservoir of add-on slurry in an oblique relation across the path of the Fourdrinier wire 6. The moving orifice applicator also includes an endless perforated steel belt 32, whose pathway is directed about a drive wheel 34, a guide wheel 36 at the apex of the moving orifice applicator 10 and a follower wheel 38 at the opposite end of the chamber box 30 from the drive wheel 34. The endless belt 32 is directed through a bottom portion of the chamber box 30 and subsequently through a cleaning box 42 as it exits the chamber box 30, moves toward the drive wheel 34 and continues along the remainder of its circumlocution.

As each orifice group 44 (FIG. 5) of the belt 32 passes through the bottom portion of the chamber box 30, the orifice 44 is communicated with the reservoir of slurry established in the chamber box 30. At such time, a stream 40 of slurry discharges from the orifice 44 as the orifice 44 traverses the length of the chamber box 30. The discharge stream 40 impinges upon the base web 22 passing beneath the moving orifice 44 so as to create a stripe of additional (add-on) material upon the base web 22. The operational speed of the belt 32 may be varied from one layout to another, but in the preferred embodiment, the belt is driven at 1500 or more feet per minute when the Fourdrinier wire is moving at approximately 800 or more feet per minute (e.g., 1000 to 3000 feet/minute) and the chamber box 30 is oriented at an angle relative to the direction of movement of the base web 22. The spacing of the orifices 44 along the belt 32 and the operational speed of the belt 32 is selected such that a plurality of streams 40, 40'emanate from beneath the chamber box 30 during operation of the moving orifice application, simultaneously. Because of the oblique orientation of the moving orifice applicator relative to the path 16 of the base web 22 and the relative speeds of the Fourdrinier wire 6 and the endless belt 32, each stream 40 of add-on material will create a stripe of add-on material upon the base web 22. By adjusting the speed of the belt and angle of the applicator 10, the moving orifice applicator 10 can repetitively generate stripes of add-on material that are oriented normal to a longitudinal edge of the base web 22. If desired, the angle and/or relative speeds may be altered to produce stripes which are angled obliquely to the edge of the base web 22.

For a particular orifice 44, after it exits from the chamber box 30, the adjacent portions of the belt 32 about the orifice 44 are cleansed of entrained add-on slurry at the cleaning station 42 and the orifice then proceeds along the circuit of the endless belt 32 to reenter the chamber box 30 to repeat an application of a stripe upon the base web 22.

Referring particularly to FIG. 1A, the moving orifice applicator is preferably situated obliquely across the Fourdrinier wire 6 at a location downstream of the dry line 20 where the condition of the base web 22 is such that it can accept the add-on material without the add-on material dispersing itself too thinly throughout the local mass of the base web slurry. At that location, the base web 22 retains sufficient moisture content (approximately 85 to 90%) such that the add-on slurry is allowed to penetrate (or establish hydrogen bonding) to a degree sufficient to bond and integrate the add-material to the base web 22.

Preferably, a vacuum box 19 is located coextensively beneath the chamber box 30 of the moving orifice applicator 10 so as to provide local support for the Fourdrinier wire 6 and facilitate the bonding/integration of the add-on slurry with the base web 20. The vacuum box 19 is constructed in accordance with designs commonly utilized in the paper making industry (such as those of the vacuum boxes 18) The vacuum box 19 is operated at a relatively modest vacuum level, preferably at approximately 60 inches of water or less. Optionally, additional vacuum boxes 18' may be located downstream of the moving orifice applicator 10 to remove the additional quantum of water that the add-on slurry may contribute. It has been found that much of the removal of water from the add-on material occurs at the couch roll 24 where a vacuum is applied of approximately 22-25 inches mercury.

The moving orifice applicator 10 is supported in its position over the Fourdrinier wire 6 preferably by a framework including vertical members 48, 48' which include a stop so that the moving orifice applicator 10 may be lowered consistently to a desired location above the Fourdrinier wire 6, preferably such that the bottom of the chamber box 30 clears the base web 22 on the Fourdrinier wire 6 by approximately one to two inches, preferably less than 1.5 inch.

Preferably, the chamber box 30 is of a length such that the opposite end portions 50, 50' of the chamber box 30 extend beyond the edges of the base web 22. The over-extension of the chamber box 30 assures that any fluid discontinuities existing arising at the end portions of the chamber box 30 do not affect the discharge streams 40 as the streams 40 deposit add-on material across the base web 22. By such arrangement, any errant spray emanating from the ends of the chamber box 30 occurs over edge portions of the base web 22 that are trimmed away at or about the couch roll 24.

Either or both of the vertical members 48, 48' of the support framework for the moving orifice applicator 10 may be pivotal about the other so as to adjust angulation of the applicator 10 relative to the Fourdrinier wire 6. However, the vertical members 48, 48' of the support framework can be fixed in place and the speed of endless belt 32 can be adjusted in response to changes in operating conditions of the paper making machine 2.

The chamber box 30 receives add-on slurry from the day tank 12 at spaced locations along the chamber box 30. Uniform pressure can be maintained along the length of the chamber box 30 by the interaction of a flow distribution system 60, a pressure monitoring system 62 and a programmable logic controller 64 such that the pumping action of the belt 22 and other flow disturbances along the length of the chamber box 30 are compensated locally and continuously to achieve the desired uniformity of pressure throughout the chamber box 30. A main circulation pulp 15 delivers slurry from the day tank 12 to the flow distribution system 60. Details regarding how the controller initiates and maintains uniform pressure along the chamber box 30 can be found in commonly assigned U.S. Pat. No. 5,997,691, the disclosure of which is hereby incorporated by reference.

Figure 3A:
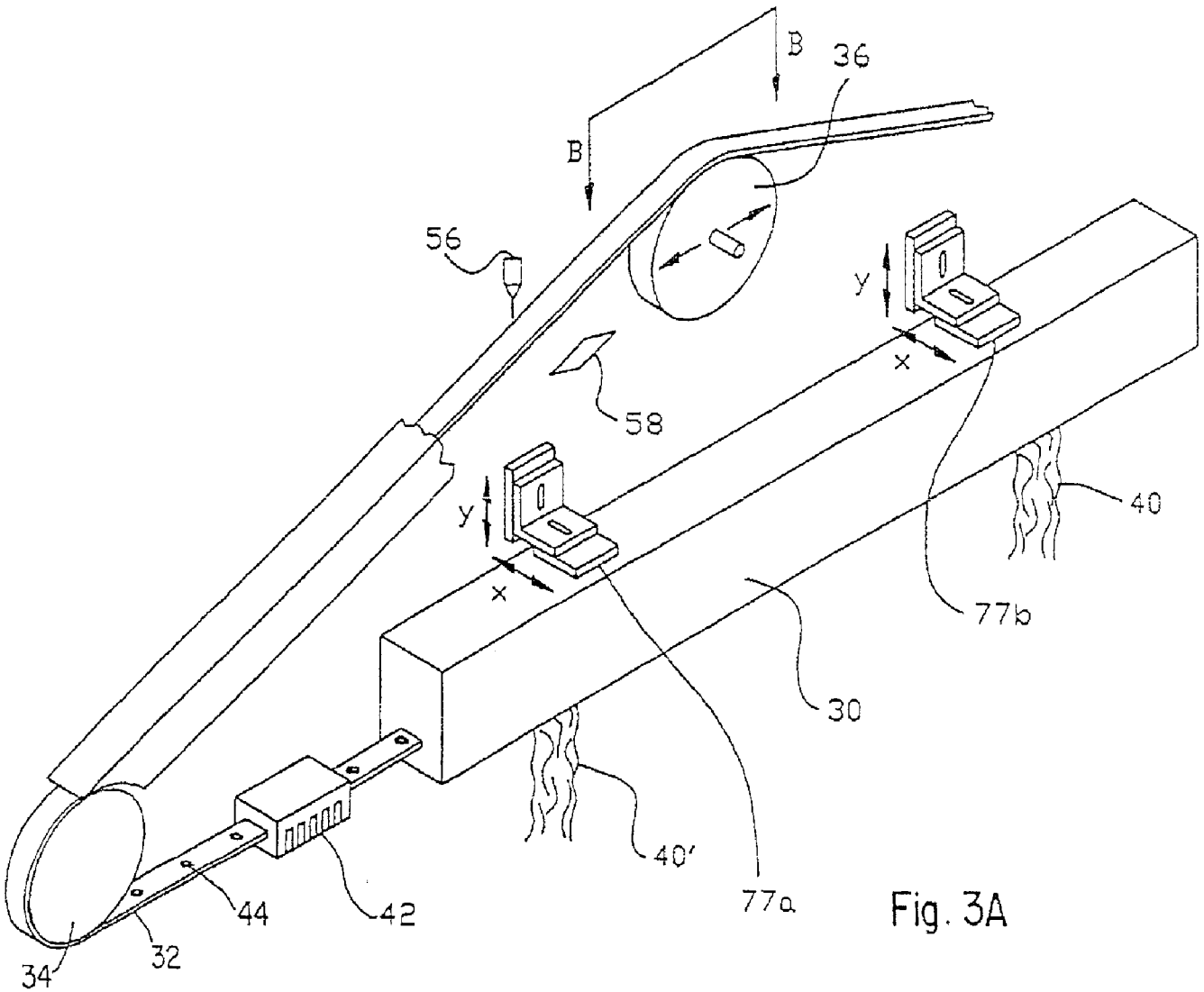
FIG. 3A is a breakaway perspective view of the applicator of FIG. 2.

Referring now to FIGS. 2 and 3A, the drive wheel 34 is driven by a selectable speed motor 52 which is operatively connected to the drive wheel 34 by a drive belt. Preferably, the motor 52 is supported by the framework of the moving orifice applicator, and both the motor 52 and the drive belt are encased within a housing 53 so as to capture any extraneous material (such as bits of slurry) that may find its way to and be otherwise flung from the drive system of the drive wheel 34. Preferably, the motor is an Allen-Bradley Model 1329C-B007NV1850-B3-C2-E2, 7.5 hp., with a Dynapa Tach 91 Modular Encoder. Of course, other types and models of motors that are known to those of ordinary skill in the pertinent art would be suitable for this application.

The drive wheel 34 is advantageously positioned upstream of the chamber box 30 along the pathway of the belt 32 so that the belt 32 is pulled through the chamber box 30. A significant degree of the directional stability is achieved by the close fit of the belt 32 throughout the length of the elongate chamber box 30. However, precise control of the tracking of the belt 32 about its pathway circuit can be effected by placement of an infrared proximity sensor 54 at a location adjacent the guide wheel 36. The infrared proximity sensor 54 can comprise an emitter 56 and a sensor 58 which are mutually aligned relative to one of the edges of the belt 32 such that if the belt strays laterally from its intended course, a signal from the sensor is affected by a relative increase or decrease in the interference of the edge with the emitter beam. A controller 59 in communication with the sensor 58 can be used to interpret the changes in the signal from the sensor 58 to adjust the yaw of the guide wheel 36 about a vertical axis so as to return the edge of the belt 32 to its proper, predetermined position relative to the beam of the emitter 56.

Suitable devices for the proximity sensor 54 include a Model SE-11 Sensor which is obtainable from the Fife Corporation of Oklahoma City, Okla.

Figure 3B:
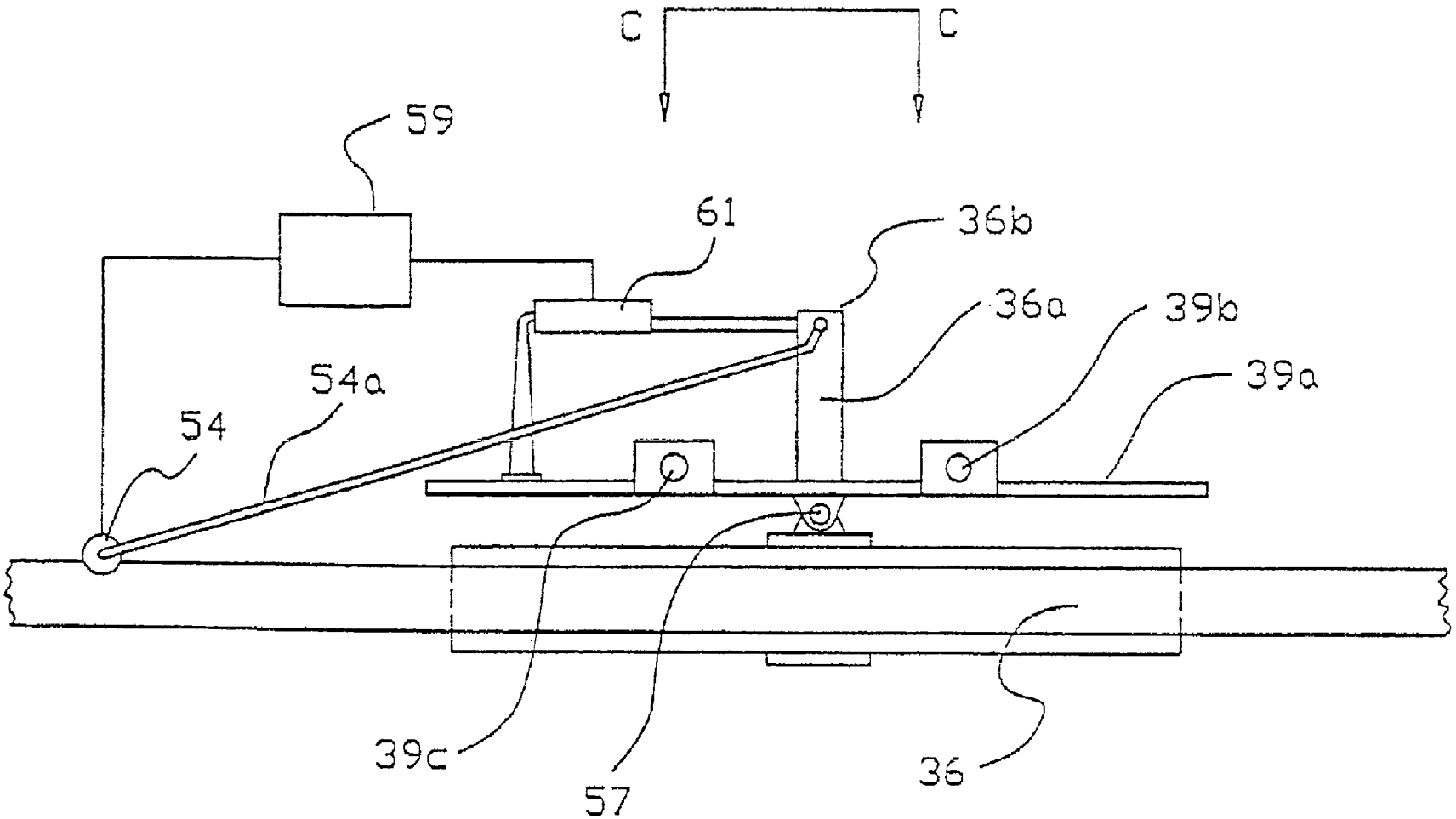
FIG. 3B is a top planar view of tracking control system of the applicator as viewed in the direction of the double pointed arrow B-B in FIG. 3A.

Referring now also to FIG. 3B, the guide wheel 36 rotates about a horizontally disposed axle 36*a*, which itself is pivotal about a vertical axis at a pivotal connection 57 by the controlled actuation of a pneumatic actuator 61 The actuator 61 is operatively connected to a free end portion 36*b* of the axle 36*a* and is responsive to signals received from the controller 59. Preferably, both the pivotal connection 57 and the actuator 61 are fixed relative to the general framework of the applicator 10 during operation of the applicator 10; and a connection 54*a* is provided between the sensor 54 and the free end 36*b* of the axle 36*a* so that the sensor 54 rotates as the yaw of the guide wheel 36 is adjusted. The connection 54*a* assures that the sensor 54 remains proximate to the edge of the belt 32 as the guide wheel 36 undergoes adjustments.

Preferably, the actuator 61 and the pivotal connection 57 are affixed upon a plate 39*a* which is vertically displaceable along fixed vertical guides 39*b* and 39*c*. Preferably, releasable, vertical bias is applied to the plate 39*a* so as to urge the guide wheel 36 into its operative position and to impart tension in the endless belt 32.

Along the return path of the endless belt 32, from the drive wheel 34 over the guide wheel 36 and back to the follower wheel 38, the belt 32 is enclosed by a plurality of housings, including outer housings 68, 68'and a central housing 70 which also encloses the infrared proximity sensor 54 and the controller 59 of the tracking system 55. The housing 68, 68' and the housing 70 prevent the flash of errant slurry upon the base web 22 as the belt 32 traverses the return portion of its circuit.

Referring particularly to FIG. 2, the housings 68, 68', 70 and various other components of the applicator 10 (such as the wheels 34, 36 and 38; the chamber box 30; the cleaning box 42; and the motor 52) are supported by and/or from a planar frame member 72. The planar frame member 72 itself is attached at hold-points 73,73' to a cross-member (an I-beam, box beam or the like), which cross-member is supported upon the vertical members 48, 48' In the alternative, an I-beam member or a box beam member may be used as a substitute for the frame member 72, with the chamber box 30 and other devices being supported from the beam member.

Referring again to FIG. 3A, in either support arrangement, the chamber box is preferably hung from the support member with two or more, spaced apart adjustable mounts 77*a*, 77*b* that permit vertical and lateral adjustment (along arrows y and x in FIG. 3A, respectively) of each end of the chamber box 30 so that the chamber box 30 may be accurately leveled and accurately angled relative to the Fourdrinier wire, and so that the chamber box 30 may be accurately aligned with the belt 32 to minimize rubbing.

Figure 4:
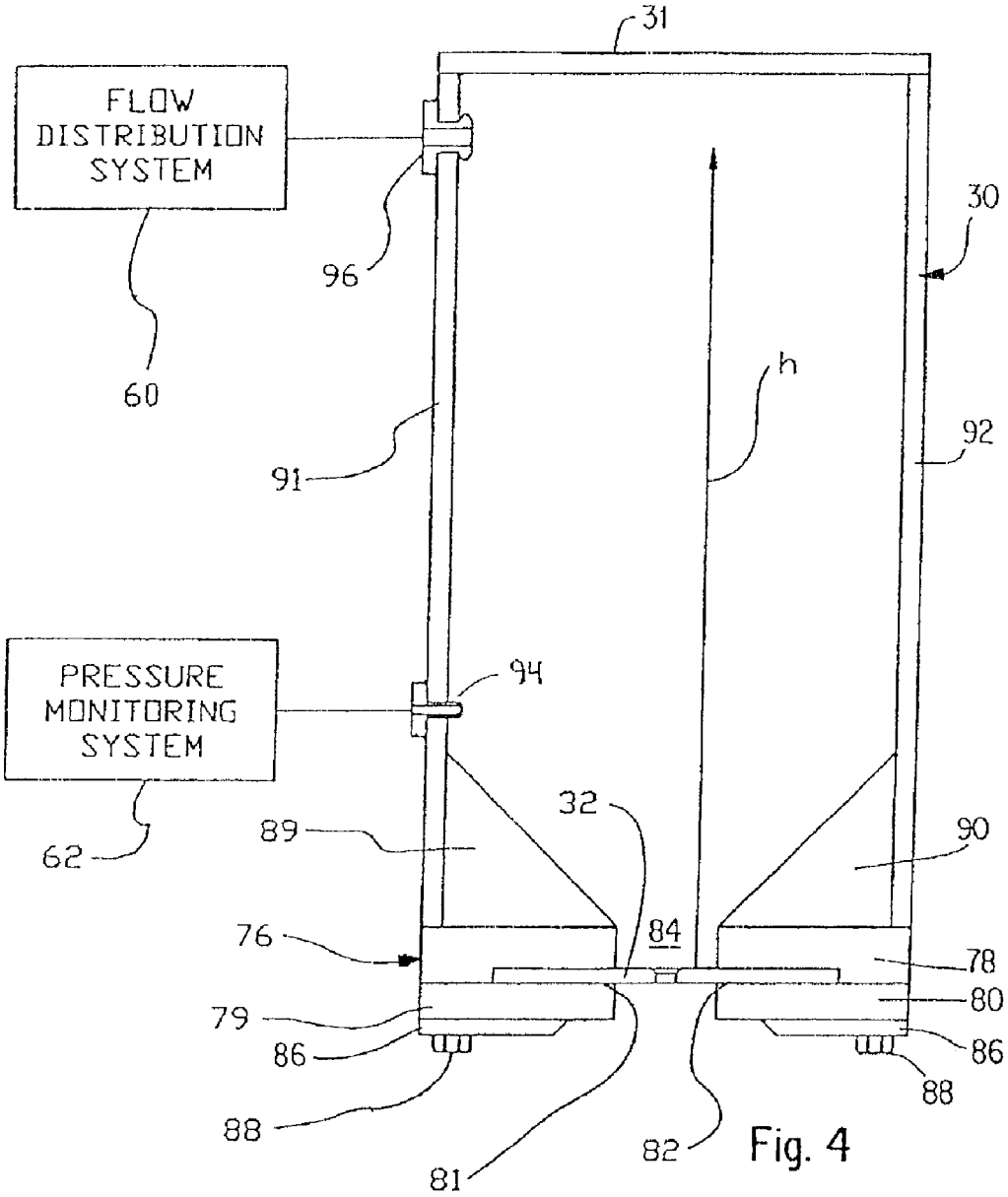
FIG. 4 is a cross-sectional view of the chamber box taken at line IV-IV in FIG. 2.

Referring now to FIG. 4, the chamber box 30 includes at its bottom portion 76 a slotted base plate 78 and first and second wear strips 79 and 80, which in cooperation with the base plate 78 define a pair of opposing, elongate slots 81 and 82 which slidingly receive edge portions of the endless belt 32. Preferably, the elongate slots 81 and 82 are formed along a central bottom portion of the base plate 78, but alternatively, could be formed at least partially or wholly in the wear strips 79 and 80.

The central slot 84 in the base plate 78 terminates within the confines of the chamber box 30 adjacent to the end portions 50, 50' of the chamber box 30. Preferably, each terminus of the central slot 84 is scalloped so as to avoid the accumulation of slurry solids at those locations. The width of the central slot 84 is minimized so as to minimize exposure of the fluid within the chamber box 30 to the pumping action of the belt 32. In the preferred embodiment, the slot 84 is approximately ⅜ inch wide, whereas the width of each of the orifices 44 in the endless belt 32 is preferably approximately 2/32 inch.

Each of the wear strips 79, 80 extends along opposite sides of the bottom portion 76 of the slurry box 30, co-extensively with the base plate 78. An elongate shim 86 and a plurality of spaced apart fasteners 88 (preferably bolts) affix the wear strips 79,80 to the adjacent, superposing portion of the base plate 78.

The tolerances between the respective edge portions of the belt 32 and the slots 81, 82 are to be minimized so as to promote sealing of the bottom portion 76 of the chamber box 30. However, the fit between the belt 32 and the slots 81,82 should not be so tight as to foment binding of the endless belt 32 in the slots 81, 82. In the preferred embodiment, these countervailing considerations are met when the slots 81, 82 are configured to present a 1/16 inch total clearance tolerance in a width-wise direction across the endless belt 32. In the direction normal to the plane of the belt, the belt has preferably a thickness 0.020 inch, whereas the slots 81, 82 are 0.023 inch deep. These relationships achieve the desired balance of proper sealing and the need for facile passage of the belt 32 through the bottom portion 76 of the chamber box 30.

Preferably, the wear strips 79, 80 are constructed from ultra high molecular weight polyethylene or Dalron.

Included within the confines of the chamber box 30 are beveled inserts 89, 90 which extend along and fill the corners defined between the base plate 78 and each of the vertical walls 91, 92 of the chamber box 30. The inserts preferably present a 45 degree incline from the vertical walls 91, 92 toward the central slot 84 of the base plate 78. This arrangement avoids stagnation of fluid in the confines of the chamber box 30, which would otherwise tend to accumulate the solid content of the slurry and possibly clog the chamber box 30 and the orifices 44 of the endless belt 32.

Near the bottom portion 76 of the chamber box 30, a plurality of spaced-apart pressure ports 94 communicate the pressure monitoring system 62 with the interior of the slurry box 30. A detailed discussion of the pressure monitoring system 62 can be found in commonly assigned U.S. Pat. No. 5,997,691, the disclosure of which is hereby incorporated by reference.

Along the upper portion of the chamber box 30, a plurality of spaced-apart feed ports 96 are located along the vertical wall 91. The feed ports 96 communicate the flow distribution system 60 with the interior of the slurry box 30. Preferably, the feed ports 96 are located close to the lid plate 31 of the chamber box 30. A detailed discussion of the flow distribution system 60 can be found in commonly assigned U.S. Pat. No. 5,997,691, the disclosure of which is hereby incorporated by reference.

The feed ports 96 are spaced vertically by a distance (h) above where the endless belt 32 traverses through the bottom portion 76 of the chamber box 30. The feed ports 96 introduce slurry into the chamber box 30 in a substantially horizontal direction. The vertical placement and the horizontal orientation of the ports 96 dampens vertical velocities in the fluid at or about the region of endless belt 32 at the bottom portion 76 of the chamber box 30. The arrangement also decouples the discharge flows 40 through the orifices 44 from the inlet flows at the feed ports 96.

The height (h) in the preferred embodiment is approximately 8 inches or more; however, the vertical distance (h) between the feed ports 96 and the endless belt 32 may be as little as 6 inches. With greater distances (h), there is lesser disturbance and interaction between the fluid adjacent the endless belt 32 and the fluid conditions at the feed ports 96.

In order to obtain uniform pressure on the slurry across the slurry box 30, the number of feed ports 96 can be adjusted accordingly. In the embodiment described above, the number of feed ports 96 amounted to twelve (12), but the invention is workable with as fewer or more inlet feed ports 96. The number of feed ports 96 depends upon the width of the paper making machine in any particular application. While a preferred spacing between the feed ports 96 is approximately 12 inches, larger or smaller spacings can be used, e.g., 8 to 24 inches.

Figure 5:
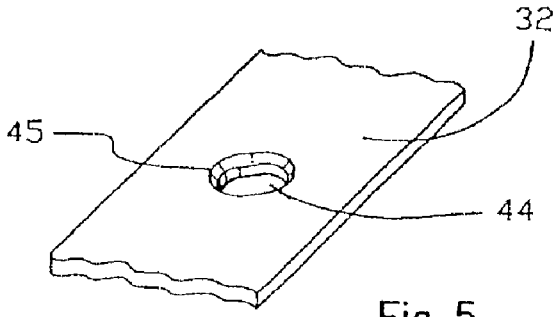
FIG. 5 is a detail perspective view of the endless belt of the applicator shown in FIG. 2.

Referring now to FIG. 5, each of the orifices 44 along the endless belt 32 includes a beveled portion 45 adjacent the side of the endless belt 44 facing into the chamber box 30. By such arrangement, the solids content of the slurry is not allowed to collect at or about the orifices 44 during operation of the applicator 10. More particularly, slurry fiber is not allowed to collect about the orifice and deflect the jets of slurry being discharged. Accordingly, the beveled portions 45 of the orifices 44 promote consistent delivery of slurry from the applicator 10 and reduce malfunctions and maintenance.

Figure 6:
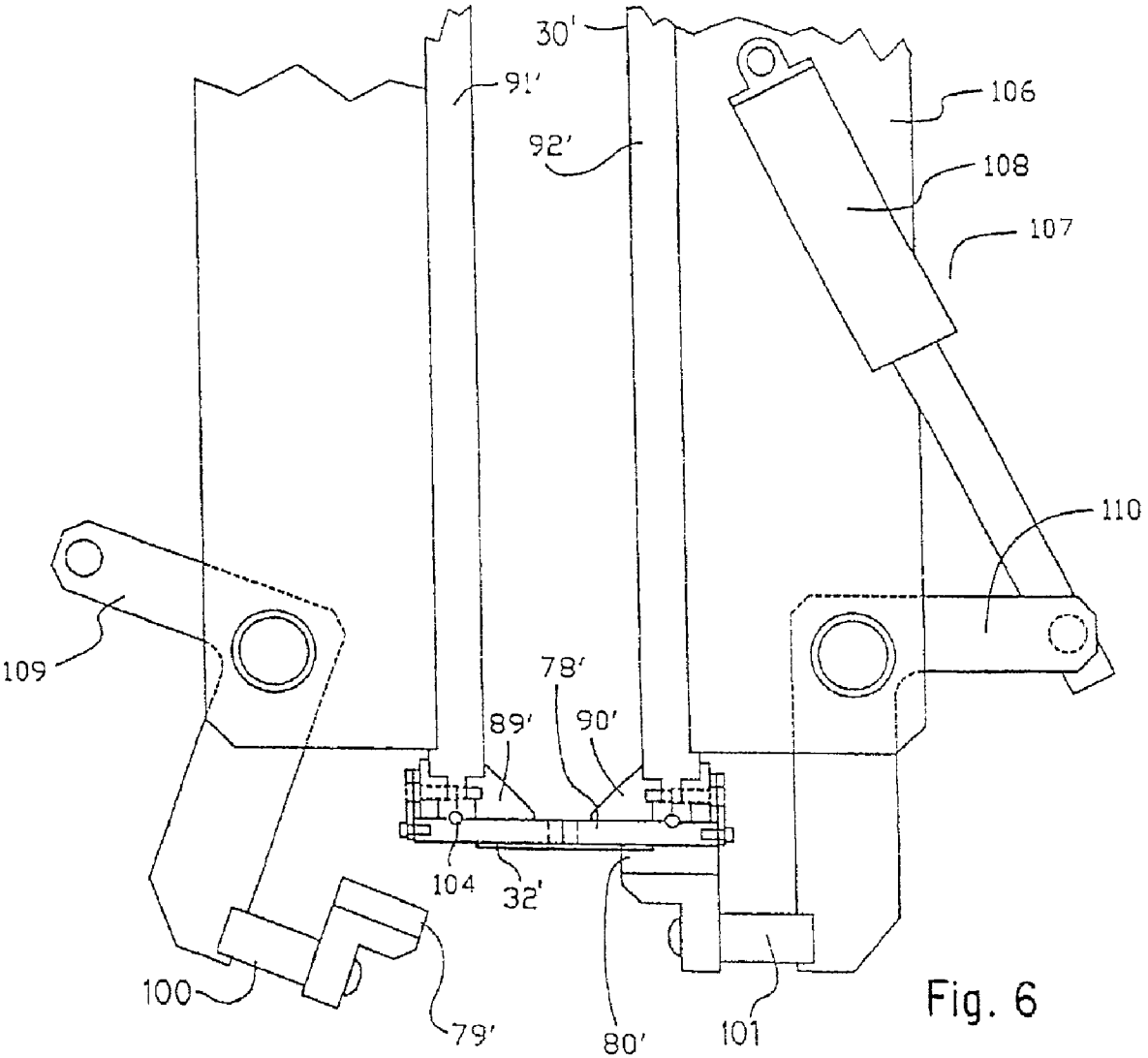
FIG. 6 is a detail, partial sectional view of an alternate embodiment of a chamber box of the applicator of FIG. 2.
Figure 7:
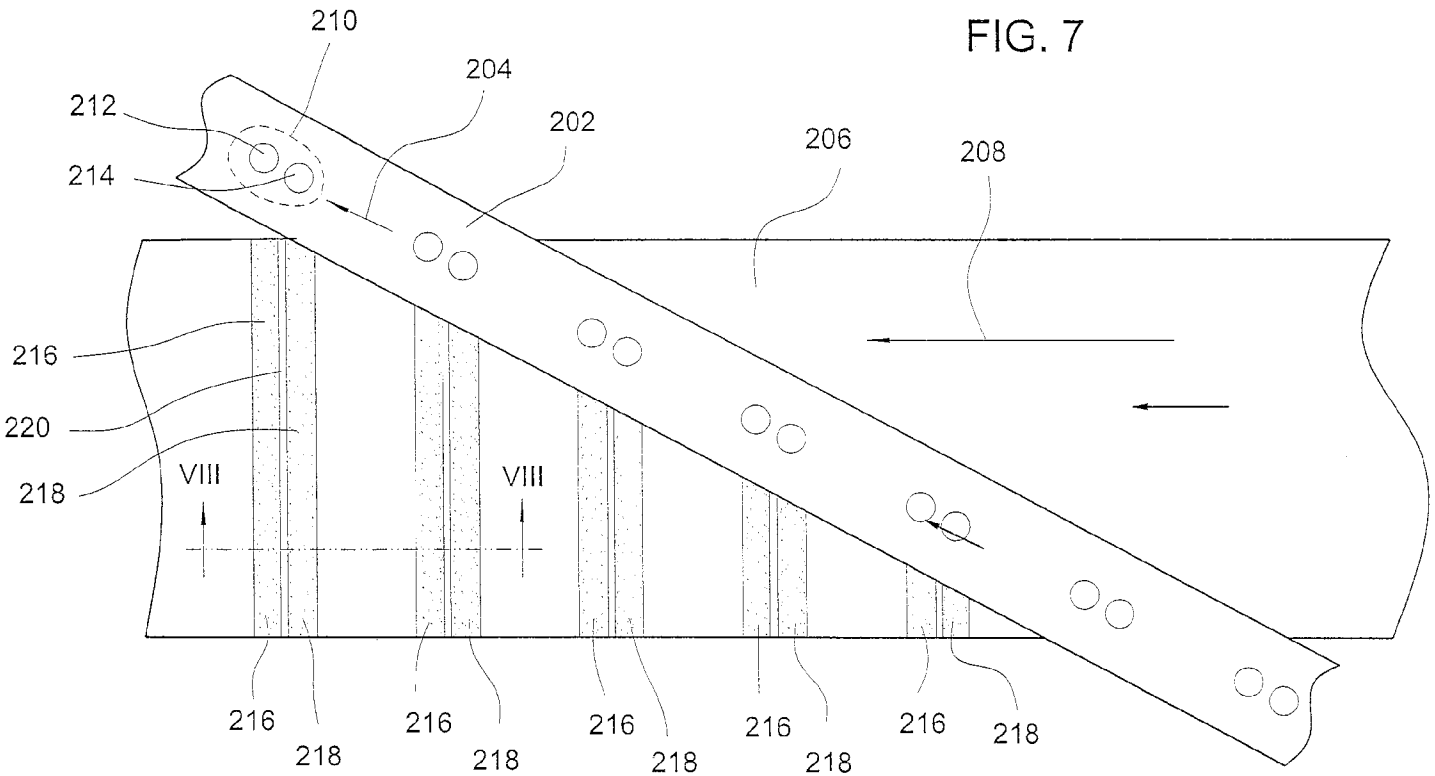
FIG. 7 is a schematic top view showing details of an exemplary belt arrangement above a moving base web.
Figure 8:
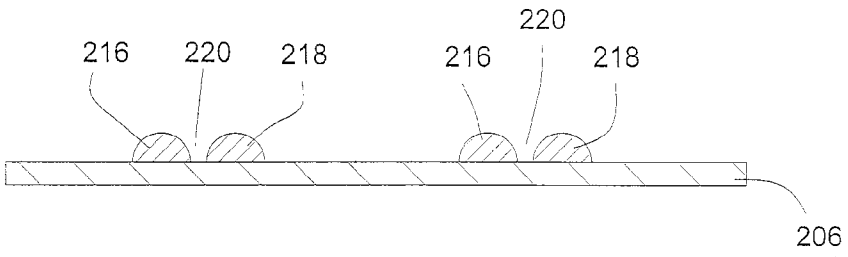
FIG. 8 is an enlarged partial cross-sectional view taken along the line VIII-VIII of FIG. 7.
Figure 9:
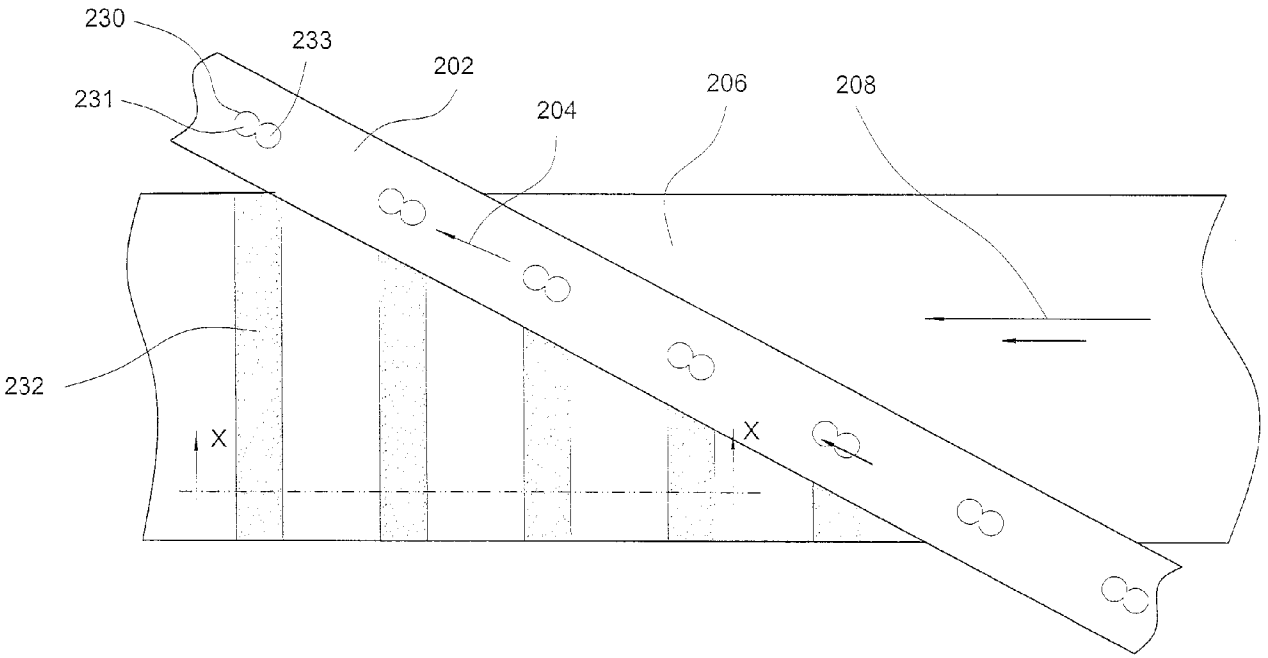
FIG. 9 is a schematic top view showing details of a second embodiment of an exemplary belt arrangement above a moving base web.
Figure 10:
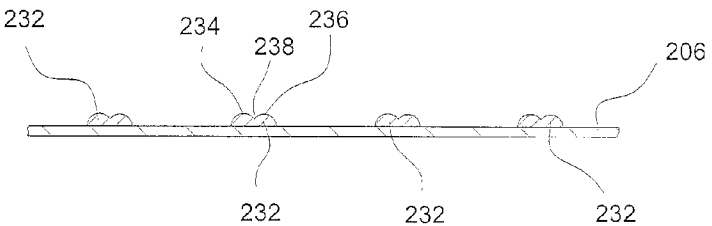
FIG. 10 is a partial cross-sectional view taken along the line X-X of FIG. 9.
Figure 11:
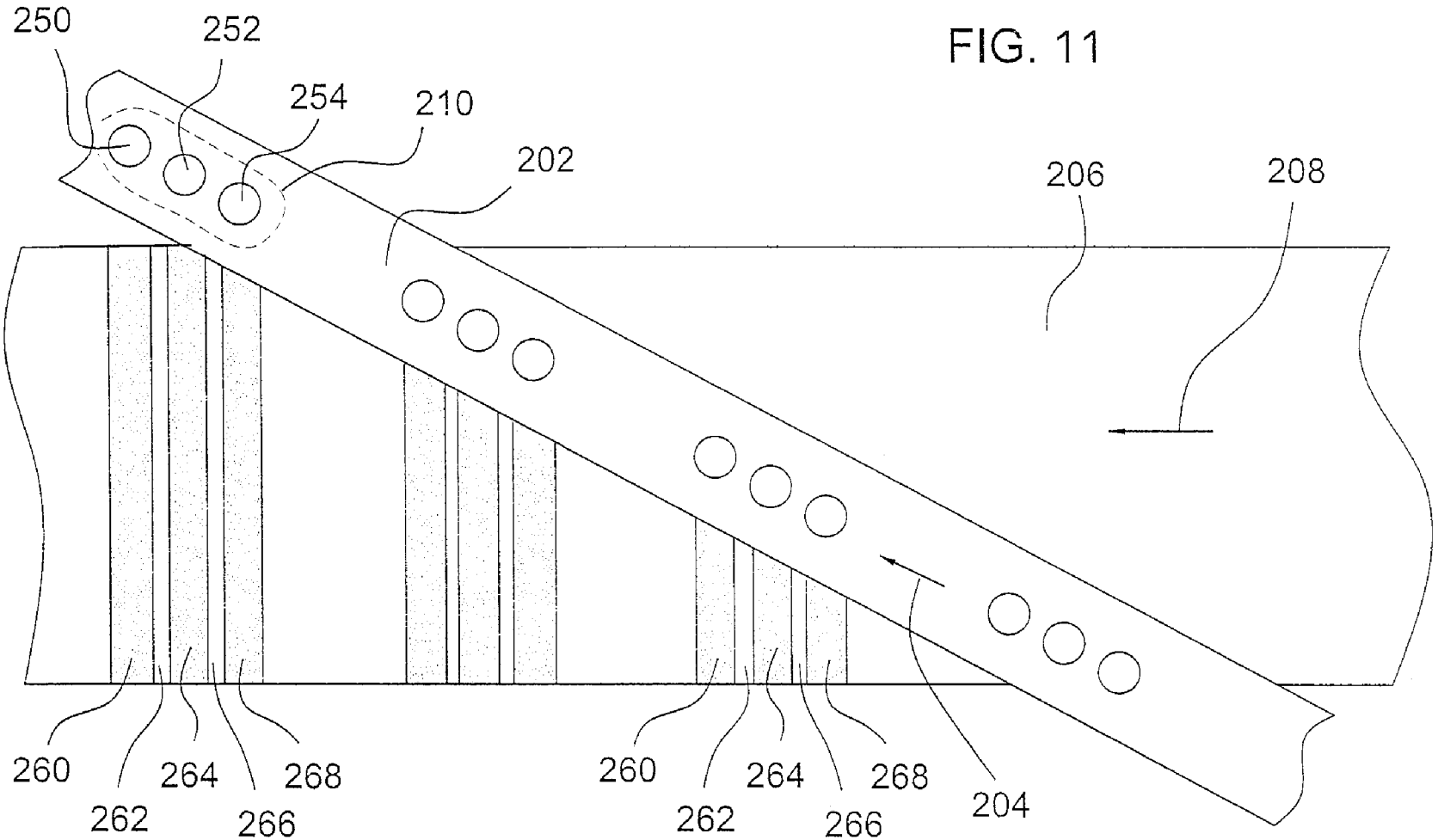
FIG. 11 is a schematic top view showing details of a third embodiment of an exemplary belt arrangement above a moving base web.

Referring now to FIG. 6, in an alternate embodiment of the chamber box 30', the vertical walls 91', 92', together with the base plate 78'and inclined beveled elements 89', 90' cooperate with retractable armatures 100, 101 which at their operative end portions support an elongate wear strip 79', 80'. The elongate wear strips extend the length of the chamber box 30'and are supported at spaced locations along each side of the chamber 30'by the retractable armatures 100 and 101. In this embodiment, the wear strips 70' and 80' are mounted upon and are retractable with the armatures 100 and 101, respectively. In FIG. 6, a plurality of armatures 100 along one side of the chamber box 30 are shown in a retracted position, while the opposed armatures 101 along the opposite side of the chamber box 30' are shown in an engaged position, where the respective wear strip 80' is biased against the base plate 78'. In actual operation, the armatures 100 and 101 are pivoted between the retracted and engaged positions simultaneously.

Each retractable armature 100, 101 is pivotally mounted upon one or a pair of vertical flanges 106, which preferably provides support for an actuator mechanism 107 for moving the retractable armature 100, 101 from an operative, engaging position where the wear strips 79', 80' are urged against base plate 78' to a retracted position where the wear strips 79', 80'are spaced away from the base plate 78' and the endless belt 32'. The actuator mechanism 107 is preferably an air cylinder 108 which is operatively connected to the pivot arms 109, 110 of the armatures 100 and 101, respectively. Other mechanical expediencies could be selected for pivoting the retractable armatures 100 and 101, as would be readily apparent to one of ordinary skill in the art upon reading this disclosure.

An elastomeric seal 104 is provided between the lower portions of the chamber box walls 91', 92' and the base plate 78' so as to create a fluid-proof seal about the entire periphery of the base plate 78'.

In operation, all of the armatures 100, 101 along both sides of the chamber box 30' are pivoted simultaneously so that the wear strips 79', 80' are moved as units to and from their operative and engaged positions. The retractable armatures 100, 101 facilitate quick and speedy maintenance, repair and/or replacement of the endless belt 32', the wear strips 79', 80' and the base plate 78'.

Referring now to FIG. 2, after progressing through the chamber box 30, the endless belt 32 enters the cleaning box 42 which is arranged to sweep away any entrained slurry that may have been carried from the box 30 by the belt 32. Preferably, the cleaning box 42 is supported from the planar frame member 72 by a bracket 110 and includes an upper and lower plate which are connected to one another so as to be biased toward each other by a spring so as to create a moderate positive clamping action toward the belt 32. Further details of the cleaning box can be found in commonly assigned U.S. Pat. No. 5,997,691, the disclosure of which is hereby incorporated by reference.

The preparation of the slurry for the production of the cigarette paper using the moving orifice applicator 10 can include cooking of flax straw feed stock, preferably using the standard Kraft process that prevails in the paper making industry. The cooking step is followed by a bleaching step and a primary refining step. The preferred process includes a secondary refining step before the majority of the refined slurry is directed to the run tank 8 of the headbox 4. Preferably, both refining steps are configured to achieve a weighted average fiber length in the flax slurry of approximately 0.8 to 1.2 mm, preferably approximately 1 mm. Preferably, a chalk tank can be communicated with the run tank 8 so as to establish a desired chalk level in the slurry supplied to the headbox.

Preferably, a portion of the slurry from the second refining step is routed to a separate operation for the preparation of an add-on slurry for application by the moving orifice applicator 10. This operation begins with the collection of refined slurry in a recirculation chest wherefrom it is recirculated about a pathway including a multi-disc refining step and a heat exchanging step before returning to the circulation chest. Preferably, in the course repeating the refining step and the heat exchanging step, heat is removed from the slurry at a rate sufficient to prevent a runaway escalation of temperature in the slurry, and more preferably, to maintain the slurry at a temperature that is optimal for the refining step, in the range of approximately 135 to 1450° F., most preferably approximately 1400° F. for a flax slurry. The add-on slurry is recirculated along this pathway of steps until such time that the add-on slurry achieves a Freeness value of a predetermined value in the range of approximately −300 to −900 milliliter °Schoppler-Riegler (ml °SR). The upper end of the range is preferable (near-750 ml °SR).

An explanation of negative freeness values can be found in "Pulp Technology and Treatment for Paper", Second Edition, James d'A. Clark, Miller Freeman Publications, San Francisco, Calif. (1985), at page 595.

Upon completion of the recirculation operation, the extremely refined add-on slurry is ready for delivery to the day tank 12 associated with the moving orifice applicator 10, wherefrom it is distributed along the length of the chamber box 30 of the moving orifice applicator as previously described. However, it is usually preferred to undertake a further recirculation step wherein the add-on slurry is recirculated from the second chest again through the heat exchanger with little or no further refining so as to achieve a desired final operational temperature in the add-on slurry (preferably, approximately 95° F.) prior to delivery to the day tank 12 and the applicator 10. Accordingly, the heat exchanger is preferably configured to serve at least dual purposes, to maintain an optimal temperatures in the add-on slurry as it is recirculated through the refiners and to remove excess heat in the add-on slurry at the conclusion of refining steps in anticipation of delivery to the applicator 10.

The second slurry chest also accommodates a semi-continuous production of slurry.

Preferably, the multi-disc refining of the recirculation pathway is performed using refiners such as Beloit double multi-disc types or Beloit double D refiners. The heat exchangers used in the recirculation pathway avoid the build-up of heat in the slurry which might otherwise result from the extreme refining executed by the multi-disc refiners. Preferably, the heat exchanger is a counter-flow arrangement such as a Model 24B6-156 (Type AEL) from Diversified Heat Transfer Inc. For the preferred embodiment, the heat exchanger is configured to have a BTU rating of 1.494 mM BTU per hour.

Fines levels in the add-on slurry range from approximately 40-70% preferably about 60%. Percentiles of fines indicate the proportion of fibers of less than 0.1 mm length.

Preferably, the slurry that is supplied to the head box 4 (the "base sheet slurry") is approximately 0.5% by weight solids (more preferably approximately 0.65%); whereas the slurry that is supplied to the moving orifice applicator 10 (the "add-on slurry") is preferably at approximately a 2 to 3% by weight solids consistency. For flax pulp, the Freeness value of fibers in the base sheet slurry at the head box 4 is preferably in the range of approximately 150 to 300 ml °SR, whereas the add-on slurry at the chamber box 30 is preferably at a Freeness value in the range of approximately −300 to −900 ml °SR, more preferably at approximately −750° SR. Preferably, the solids fraction of the base sheet slurry is approximately 50% chalk and 50% fiber, whereas in the add-on slurry, the relationship is 0 to 10% chalk and 90% or more fiber. Optionally, the add-on slurry may include a 5 to 20% chalk content, preferably a Multiflex that is obtainable from Speciality Minerals, Inc. or the add-on material can be chalk-free.

Figure 1B:
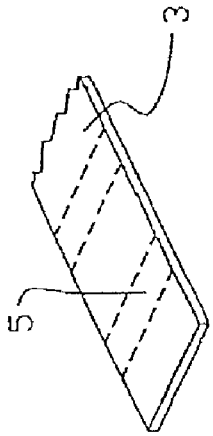
FIG. 1B is a perspective view of a paper constructed in accordance with the methodologies and apparatus of the present disclosure.
Figure 1C:
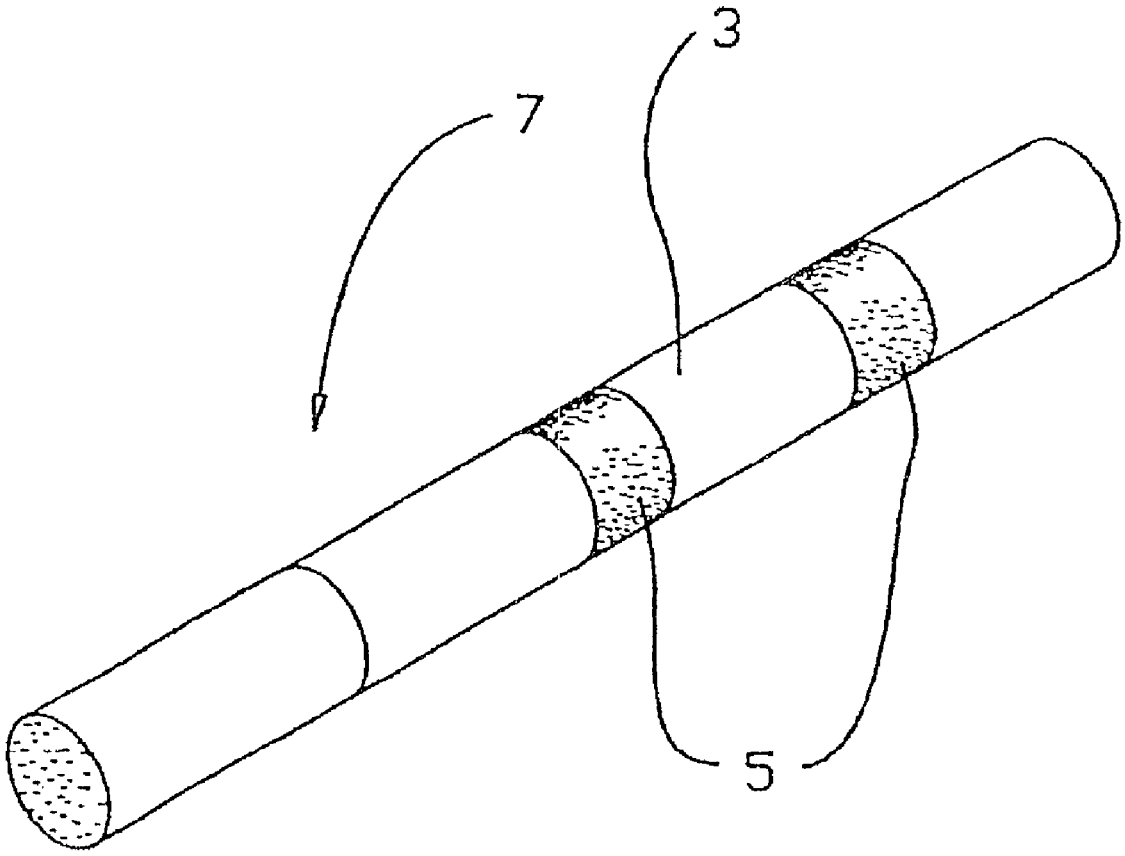
FIG. 1C is a perspective view of a cigarette constructed with the paper of FIG. 1B.

As previously described in reference to FIG. 1A, the add-on slurry is applied to the base web by the applicator 10, whereupon water is further removed and the sheet is dried upon passage through the drying felts 26. Referring now also to FIG. 1B, at the conclusion of the paper making process, a paper is constructed having a base sheet portion 3 and a plurality of uniformly applied, uniformly spaced, mutual parallel banded regions 5 of highly refined add-on cellulosic material of weighted average fiber length in the range of approximately 0.15 mm to 0.20 mm. In these banded regions 5, the cigarette paper has a reduced air permeability in comparison to that of the regions of the base sheet 3 between the banded regions 5. Referring now also to FIG. 1C, the paper is wrapped about a column of tobacco to form the tobacco rod of a cigarette 7, which will at the banded regions exhibit a slower burn rate in comparison to those regions of the base sheet 3 between the banded regions 5.

The operation of the cigarette paper making machine and method of the preferred embodiment has been described with respect to flax feedstock. The apparatus and associated methodologies are readily workable with other feedstocks such as hardwood and softwood pulps, eucalyptus pulps and other types of pulps used in the paper making industry. The alternate pulps may have different characteristics from flax, such as differences in average fiber length, which may necessitate adjustment of the degree of refining in the preparation of the base sheet slurry with some pulps. With an alternative pulp, it may be acceptable to skip one or both of the refining steps, particularly if the pulp exhibits a very short average fiber length in comparison to flax. However, in order for the preparation of the add-on slurry to progress satisfactorily, the slurry which is to be diverted to the recirculation chest should exhibit an initial weighted average fiber length approximating that previously described for the refined flax base sheet slurry, that is, having a weighted fiber length of approximately 0.7 mm to 1.5 mm and more preferably approximately 0.8 mm to 1.2 mm. With these alternative pulps, the add-on slurry is recirculated through the refining step and the heat exchanging step until a comparable desired Freeness value is obtained (in the range of −300 to −900 ml °SR, preferably approximately −750 ml °SR). As with flax, the extreme degree of refining of the add-on slurry avoids fiber build-up at or about the orifices 44 of the belt, which in turn avoids jet deflections at the orifices 44.

Because the flow of the fluid stream 40 emanating from each orifice 44 as the orifice 44 passes along the bottom portion of the chamber box 30 is proportional to the pressure differential across the orifice 44, it is desirable that fluid pressure be established and then held as uniformly as possible along the entire journey of each orifice 44 along the bottom portion 76 of the chamber box 30. Details of suitable flow controls of the slurry add-on material can be found in commonly assigned U.S. Pat. No. 5,997,691, the disclosure of which is hereby incorporated by reference.

It will be apparent from the foregoing that the invention provides a orifice group device for use in applying banded regions to a sheet of material such as a sheet of cigarette paper during high speed production of the sheet. The orifice group device can be used with large-capacity (e.g., widths of 8 feet and greater) papermaking machines which tend to operate at high machine speeds (e.g., over 800 feet/minute).

In a preferred embodiment, the orifice group device includes a hopper supplying a slurry to a slotted belt. The slotted belt travels around the sheet and slurry from the hopper and is deposited as spaced apart bands across a sheet of cigarette paper with the bands extending perpendicularly to the travel direction of the paper. The slotted belt includes slots which are spaced apart and parallel to each other. For example, the slots can be inclined relative to a direction of travel of the belt, e.g., the slots can be elongated in directions forming an angle of 15 to 750, preferably 25 to 65° with the travel direction of the belt. The slots preferably have the same size and are preferably at the same angle with respect to the direction of belt travel. The slot dimensions may be tailored to execute various applications by selecting total area of an orifice sufficient to achieve a desired flow rate at desired operational pressure and by selecting an orifice width that provides a desired band width at the same desired flow rate and desired operational pressure.

In general, the slots can be identical in size and parallel to each other. A preferred slot length is approximately 1/16 to 3/16 inch and a preferred slot width is approximately 1/16 to 3/32 inch. As an example, to make 3 to 10 mm wide bands such as 5 to 6 mm wide bands on a base web of a paper sheet traveling at speeds of 800 feet/minute and higher on a Fourdrinier wire, the slots can have dimensions of 2/32 inch by 4/32 inch. Further, in order to provide bands perpendicular to the travel direction of the base web, the orifice group device is preferably oriented at an angle to the travel direction of the base web such that the slotted belt travels in a direction which deposits the bands perpendicular to the travel direction of the base web.

FIGS. 7 through 10 show details of an exemplary belt arrangements and the resulting wrapper paper. The orifice belt 202 (see FIG. 7) may be fabricated from stainless steel or another suitable material. The orifice belt 202 may have a width on the order of 1.5 inches and a thickness on the order of 0.020 inches. In use, the orifice belt 202 advances in the direction of the arrow 204. Preferably, the longitudinal axis of the orifice belt 202 is angled at about 25° to about 30° to the longitudinal axis of the paper web 206 moving below the orifice belt 202 in the direction of the arrow 208. More preferably, the angle between the longitudinal axis of the orifice belt 202 and the paper web 206 is about 27° in this particular embodiment.

As noted, the orifice belt 202 is arranged to be an endless loop in use. A plurality of orifice groups 210 may be uniformly spaced along the longitudinal axis of the orifice belt 202. For example, about 200 to about 300 orifice groups 210 may be used. The orifice groups 210 may be spaced from one another by a distance in the range of about 1.8 to about 2.7 inches, and more preferably about 2.15 inches.

Those skilled in the art will appreciate that the spacing between orifice groups corresponds to spacing between the corresponding stripes deposited on the moving web. Conversely, the desired spacing between groups of stripes on the moving web will determine the appropriate spacing between corresponding adjacent orifice groups on the orifice band 202. While the spacing between groups of stripes on the moving web are likely to be uniform or regular, wrapper designs may be developed in which non-uniform or irregular. Accordingly, the spacing between orifice groups on the orifice band 202 may be uniform, regular, non-uniform, or irregular. Of course, if single orifices are used, the single orifices may also be uniformly, regularly, non-uniformly, or irregularly spaced from one another.

Each orifice group preferably includes a first generally circular orifice 212 spaced from a second generally circular orifice 214. Typically, each orifice 212, 214 may have a diameter in the range of 0.050 to 0.075 inches, preferably about 0.063 inches. Moreover, each orifice 212, 214 may be countersunk so as to facilitate movement of fluid therethrough. The spacing between the orifices 212, 214 of each group 210 may be selected such that an imaginary line in the transverse direction of the web or perpendicular to the direction of base web movement (i.e., the arrow 208) is tangent to one or both orifices 212, 214, but the imaginary line preferably does not intersect either orifice 212, 214. Preferably, the centers of the orifices 212, 214 are spaced from one another by a distance of about 0.138 inches. With the foregoing arrangement, stripes of add-on material deposited through the orifices 212, 214, will either be adjacent to one another or will be spaced from one another in the direction of the arrow 208.

More particularly, as the orifice belt 202 moves across the moving based web 206, the first orifice 212 will deposit a corresponding stripe 216 of add-on material on the base web 206. Similarly, the second orifice 214 will deposit a corresponding stripe 218 of add-on material on the base web 206. When the imaginary line discussed above is only tangent to one orifice and does not touch the other orifice, a space 220 will be defined between the stripes 216, 218 of add-on material (see FIG. 8). Stated differently, the orifices of the orifice group are spaced from one another in accordance with desired band patterns on smoking articles, such as the exemplary patterns of FIGS. 7, 9, 11, and 24(*a*)-(*e*).

In another embodiment, the orifice group 230 (see FIG. 9) may comprise a pair of generally circular orifices 231, 233 which are spaced more closely that the orifices discussed above in connection with FIG. 7. More specifically, the orifices 231, 233 are spaced such that one or both orifices are intersected by the imaginary line extending perpendicularly to the direction of travel of the base web 206 (i.e., the arrow 208). If desired, the orifices 231, 233 may intersect so as to define an hourglass or figure-8 shape for the orifice group 230.

With the orifices 231, 233 arranged as described, each orifice group 230 will deposit a corresponding stripe 232 of add-on material on the base web 206 as the orifice belt 202 moves relative to the moving base web 206. But, unlike a simple circular or elongated orifice, the orifice group 230 will deposit a stripe 232 having a controlled, variable thickness. More specifically (see FIG. 10), the first orifice 231 deposits a stripe of material, the edge of which overlaps the edge of the stripe of material deposited by the second orifice 233. In cross-section, the resulting stripe 232 has a thickness which varies between the leading edge 240 of the stripe and the trailing edge 242 thereof. That thickness variation exhibits a relative maximum 234 in a position generally aligned with the center of the first orifice 231 and a second relative maximum 236 generally aligned with the center of the second orifice 233. Between the relative maxima 234, 236 the profile exhibits a relative minimum 238.

From the foregoing discussion, it will be apparent that by adjusting the spacing between orifices of the orifice group, paper can be formed having stripes that are closely adjacent to one another in groups. Furthermore, the spacing can be adjusted such that a single stripe results with material having a relative minimum about half way between the leading and trailing edges of the stripe. Moreover, those skilled in the art will also understand that each orifice group may include three or more orifice elements (see FIG. 11). With three or more orifice elements 250, 252, 254, the web 206 for making resulting wrapper paper will exhibit stripe groupings having a corresponding number of individual stripes 260, 264, 268 with interdigitated spaces 262, 266 or a corresponding number of relative thickness maxima—depending upon the spacing between the individual orifices of the orifice group 210.

While the foregoing discussion has described the preferred embodiment of the individual orifices as being generally circular, those skilled in the art will also appreciate and understand that non-circular orifice may also be used without departing from the spirit and scope of this disclosure. For example, generally quadrilateral orifices, generally rectangular orifices, generally square orifices, generally elliptical orifices, generally polygonal orifices, and irregularly shaped orifices are all within the spirit and scope of this disclosure. In addition, the orifices of each group need not be equal in size.

While the discussion above principally deals with continuous transverse stripes, the apparatus can be modified to generate a web having a plurality of transverse stripes that are piecewise continuous, i.e., each stripe may have a plurality of breaks, gaps, openings, or spaces which occur at substantially uniform, predetermined intervals in the transverse direction of the web. As will be described with more particularity below, the shape of those breaks, gaps, openings, or spaces can be designed to have nearly any desired shape. For convenience, references to "gap space" below are intended to include a break, a gap, an opening, a space, or any other adjective that might be used to describe the discontinuity between adjacent, substantially aligned portions of a stripe.

Figure 12:
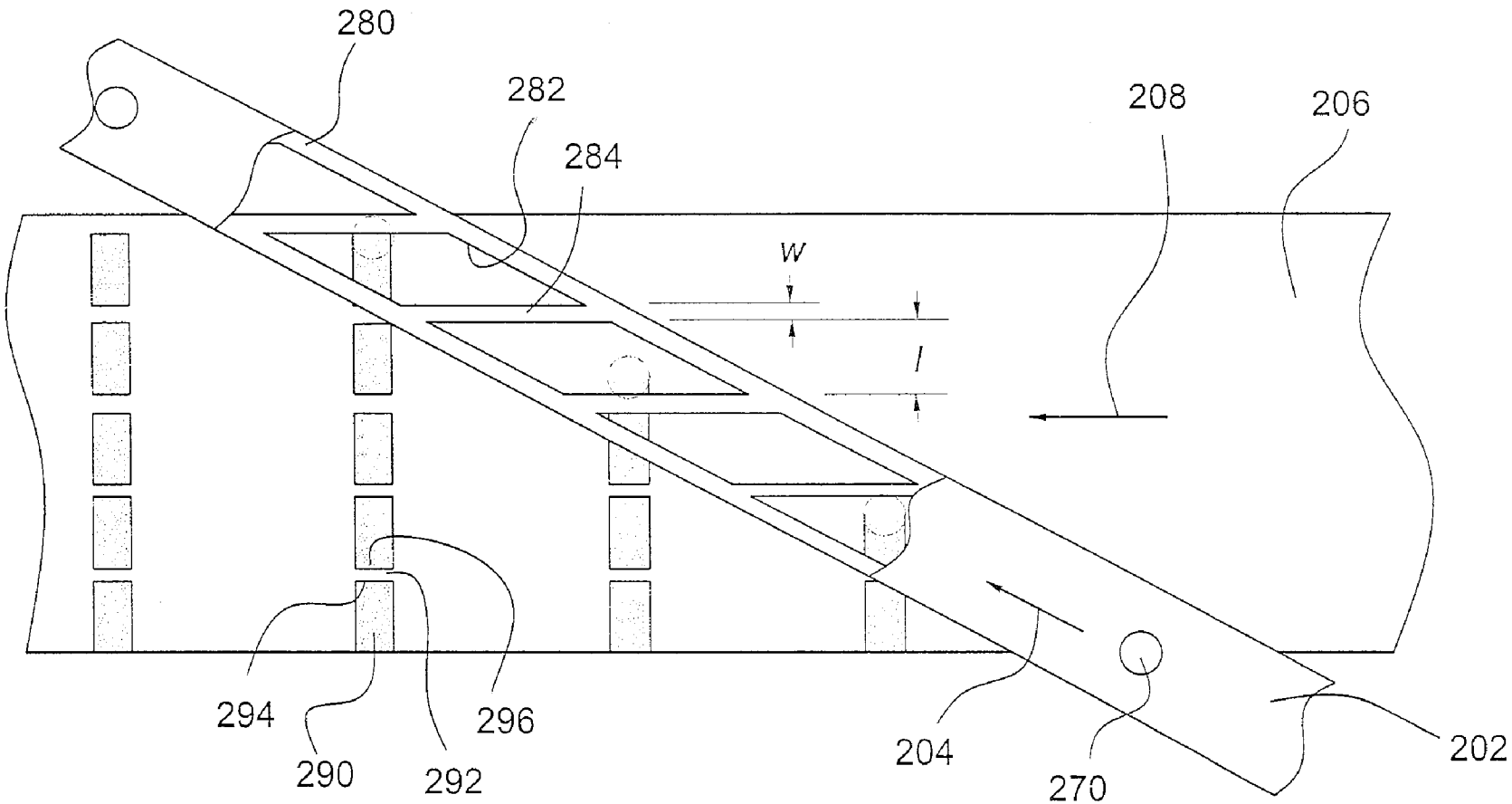
FIG. 12 is a schematic top view showing details of an arrangement including a fixed base plate between the belt and the moving web.

Turning now to FIG. 12, a modification of the slurry box described above is shown. As with embodiments discussed above, the belt 202 moves in the direction of the arrow 204 and includes a plurality of orifices 270 which may be generally circular, as depicted. The belt 202 moves across, and above, the underlying web 206 moving in the direction of arrow 208 on a paper-making machine. Those features of the apparatus have been discussed above, and the salient characteristics of those features has been described so that further elaboration is not required again.

A template 280 is positioned below the moving orifice belt 202, in cooperative relationship to the orifice belt 202, and above the moving web 206. The template 280 may, for example, be a modified base plate or a moving template belt. The template belt or member 280 includes a plurality of substantially uniform windows 282 spaced along the longitudinal direction of the belt 202. The shape of the windows 282 in combination with the shape of the orifices 270 of the moving belt, the speed of the orifice belt 202 relative to the web 206, and the speed of the template belt or member 280 relative to the web 206 cooperate to define the characteristics the discontinuous stripe 290 deposited on the web 206.

More particularly, where the window 282 has the shape of a parallelogram with parallel sides of the parallelogram aligned with the longitudinal direction of the web 206, the speed of the belt 202 correlated to the speed of the web 206 as described, and with the template belt or member 280 being stationary, the transverse stripes or bands 290 on the web 206 includes a plurality of gap spaces 292 positioned at predetermined intervals along the transverse direction of the web 206. In this embodiment, the gap spaces 292 are defined by substantially parallel edge 294, 296 which extend in the longitudinal direction of the web 206.

The width of these gap spaces 292 and the length of the stripe portions, both measured in the transverse or cross-web direction, is dictated by the characteristics of the windows 282 of the template belt or member 280. Adjacent windows 282 of the template belt or member 280 in this embodiment define cross members 284 having a width w measured in the cross-web direction. Adjacent cross members 284 are spaced from one another by a distance I, also measured in the cross-web direction. The width w defines the width (i.e., transverse dimension) of the gap opening, while the distance I defines the transverse length of the stripe portions deposited on the web 206 by orifices 270 of the moving belt. In this embodiment the member 280 may serve as the equivalent to the base plate 78 previously described, but modified with the additional template features and functions of the member 280 as just described.

Figure 13:
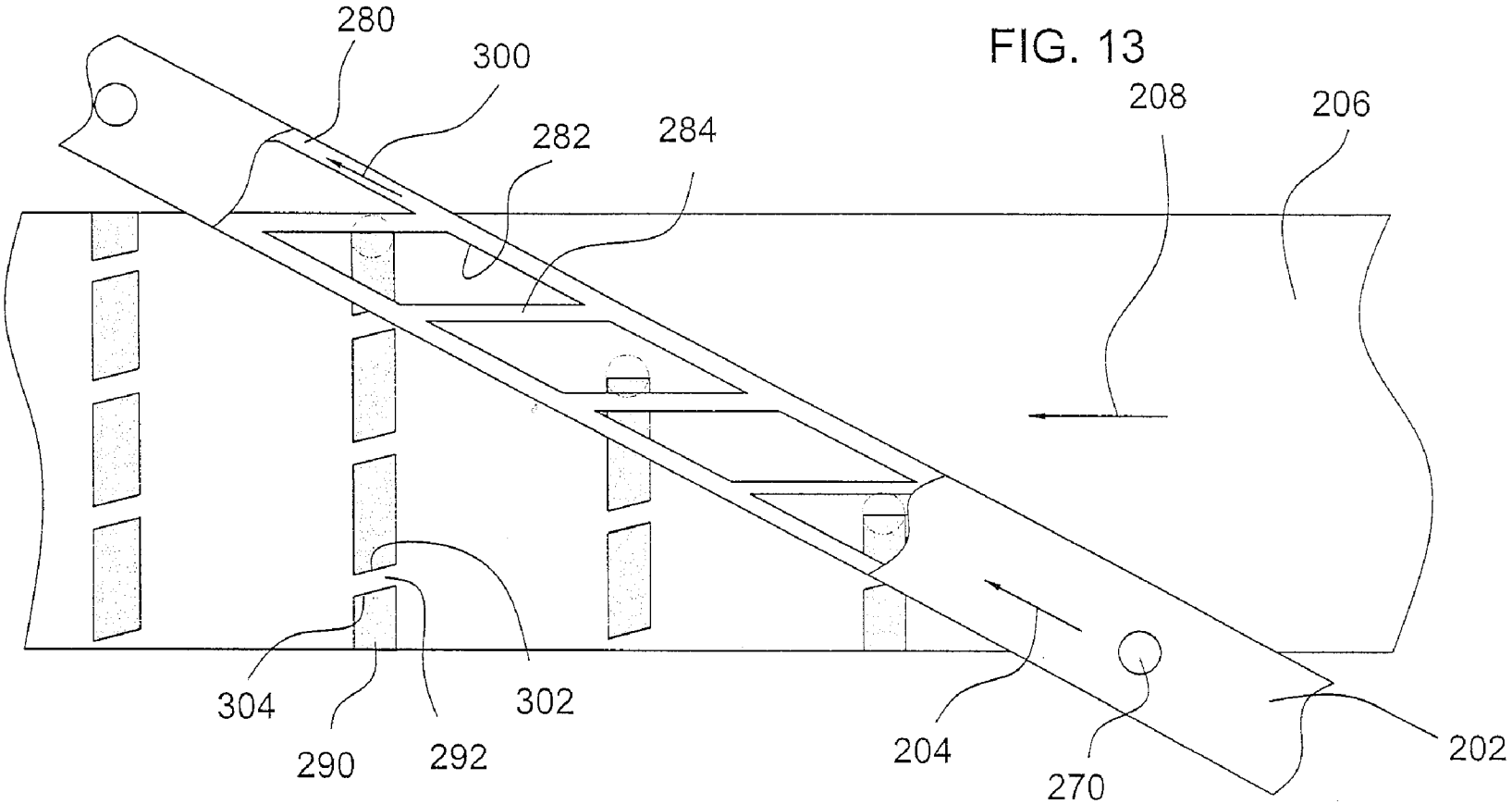
FIG. 13 is a schematic top view showing details of an arrangement including a moving base plate between the belt and the moving web.

Another configuration of the gap spaces 292 can be obtained by modification of the apparatus (see FIG. 13). Here, the template belt or member 280 is fashioned as a substantially continuously moving template belt, preferably fabricated from stainless steel, that is operable to move substantially collinearly with the orifice belt 202. Accordingly, in this embodiment and in others like it, there is a separate base plate 78 as previously described. The template belt or member 280 preferably moves in the direction of the arrow 300, which has the same direction as the movement 204 of the belt 202. The speed of the support member 280 is different from the linear speed of the orifice belt 202 so that movement of the support member 280 can be used to control the cross-web or transverse spacing between gap spaces 292 (i.e., the distance I). The edges 302, 304 of the gap space 292 in this embodiment are schematically depicted in FIG. 13.

Actual configuration of the edges 302, 304 can be determined in a number of ways. However, one graphical method can be used for this embodiment as well as other embodiments discussed herein. The edge configurations are determined by relative motion of the web 206, the belt 202, and the template belt or member 280, along with the shape of the orifices 270, and the shape of the windows 282. From the perspective of the moving web, the cross pieces 284 of the template belt or member 280 move longitudinally along the web 206 at the speed of the web, and may have a trigonometrically determined transverse speed if the template belt or member 280 is moving. From the perspective of the moving web 206, the orifices 270 of the belt 202 move in the cross-web direction at a constant velocity determined by the speed of the web 206 and angle between the belt 202 and a longitudinal edge of the web 206. Starting with the condition where the contour of the orifice 270 first touches the contour of the cross-piece 284, and looking at the relative movements of the orifice contour and the cross piece contour at consecutive incremental time intervals, points on the actual edges 302, 304 are determined. When those points are joined, the actual contour of the edges 302, 304 on the moving web 206 are established.

Figure 14:
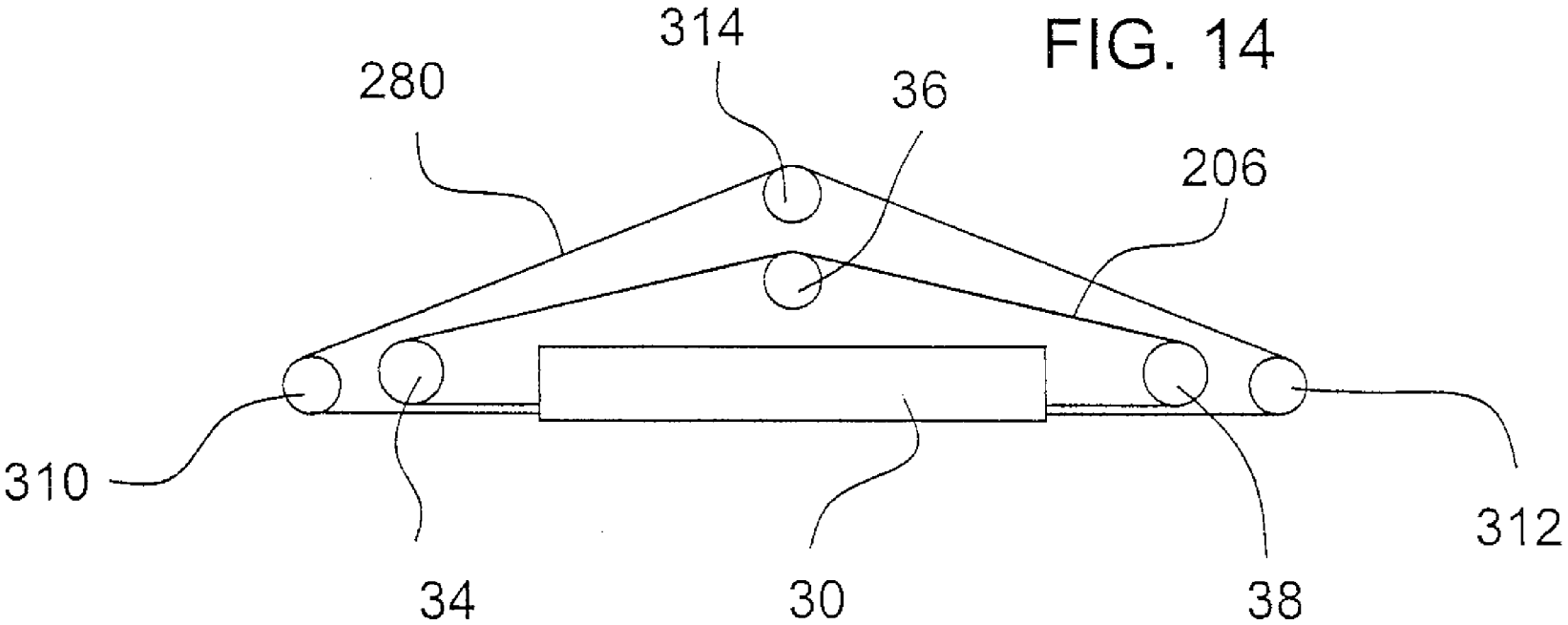
FIG. 14 is a schematic side view showing operation of a moving base plate and a moving belt.

For an embodiment where the base plate or template belt 280 moves, an exemplary support and driving structure (see FIG. 14) may be similar to the structure discussed above in connection with the moving orifice belt 206. For example, the template belt or member 280 may be an endless stainless steel strip supported on a drive wheel 310, a guide wheel 314, and a follower wheel 312 so that the template belt or member 280 passes through the chamber box 30 at a position below the orifice belt 206. Where the template belt or member 280 passes through the chamber box 30, suitable fluid seals as described above in connection with the orifice belt 206 may be provided and employed. Alternatively, the template belt or member 280 may simply be located under the chamber box 30 in close proximity to a base plate 78 and/or the orifice belt 206, such that seals between the template belt or member 280 and the chamber box 30 are not necessary. The drive wheel 310, the guide wheel 314, and the follower wheel 312 are positioned outwardly of the corresponding elements supporting and moving the orifice belt 206, and may be similarly mounted for independent operation independent of the orifice belt 206. A conventional drive means may be operatively including the drive wheel 310 is provided to move the template belt or member 280 at a predetermined speed, as discussed above.

In all embodiments, the member 280 serves as a template for interrupting flows emanating from the moving orifices of the orifice belt 202.

Figure 15:
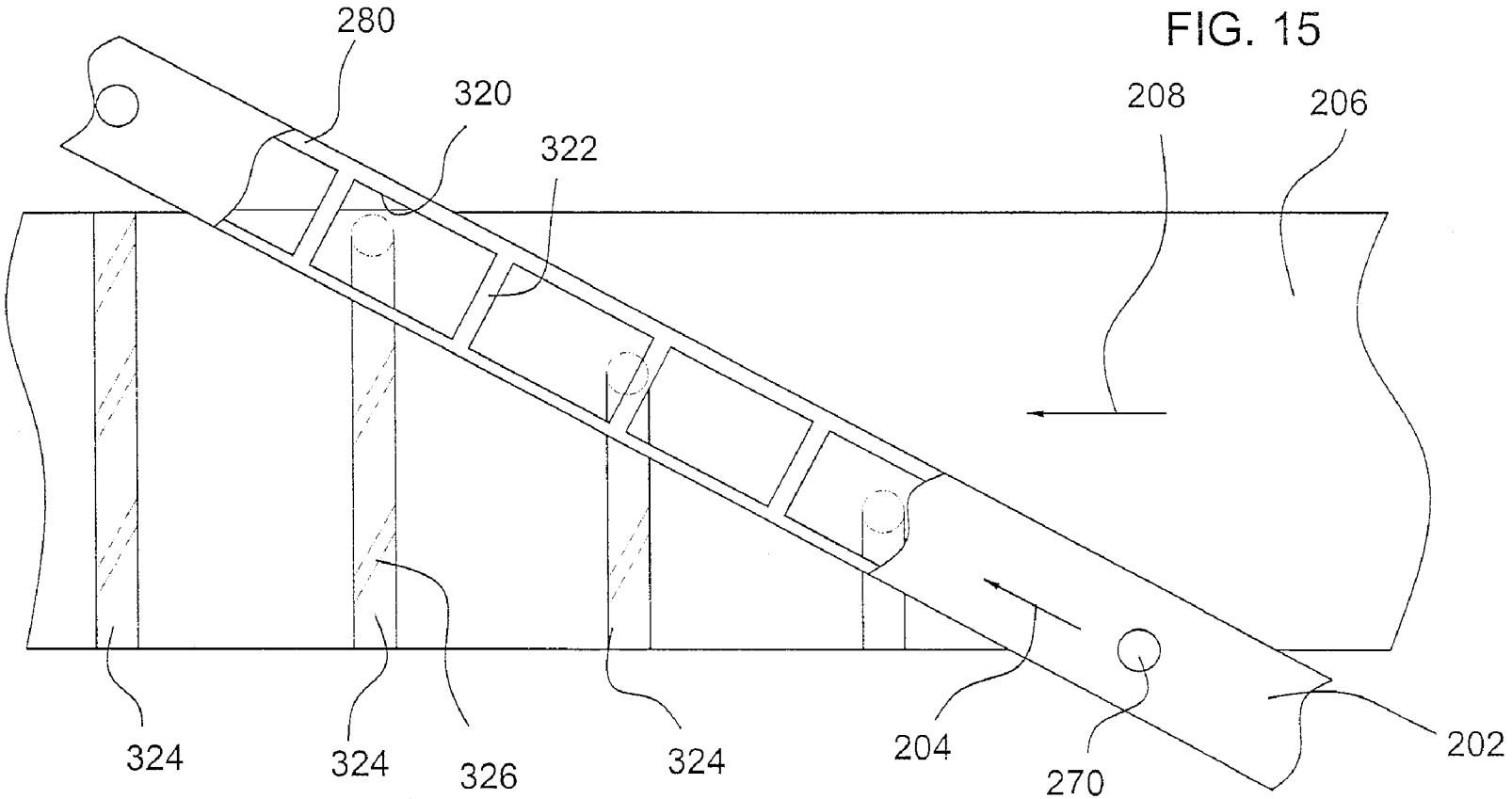
FIG. 15 is a schematic top view showing a second embodiment of the base plate.

A myriad of other embodiments for the apparatus are within the spirit and scope of this disclosure. For example, the windows 320 (see FIG. 15) of the template belt or member 280 may be generally rectangular such that the cross pieces 322 are positioned at an acute angle relative to a longitudinal edge of the web 206. The quadrilateral windows 320 may be generally square, generally rectangular or the like such that the cross pieces 322 are angularly oriented relative to an edge of the web 206.

Figure 16:
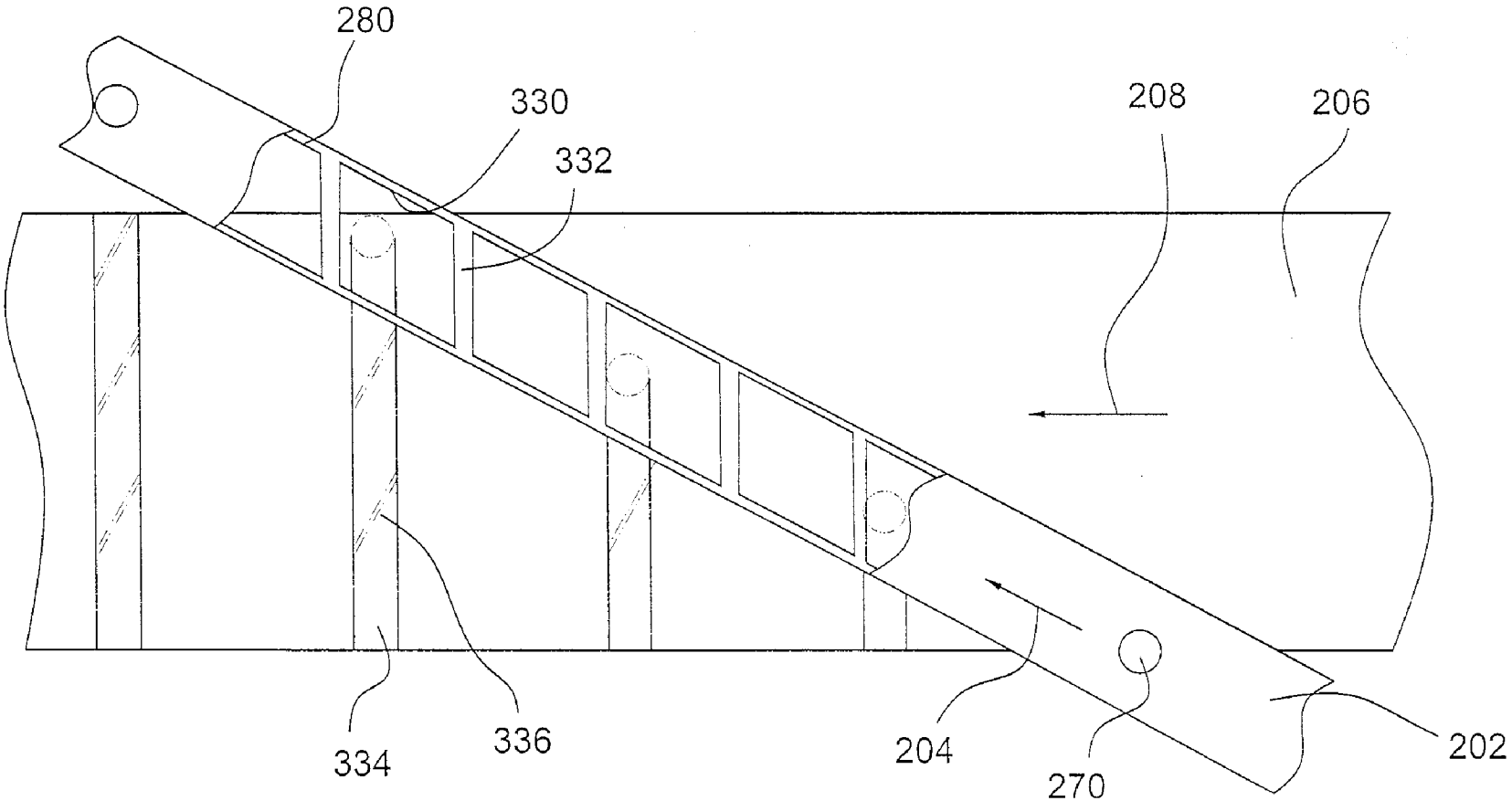
FIG. 16 is a schematic top view showing a third embodiment of the base plate.
Figure 17:
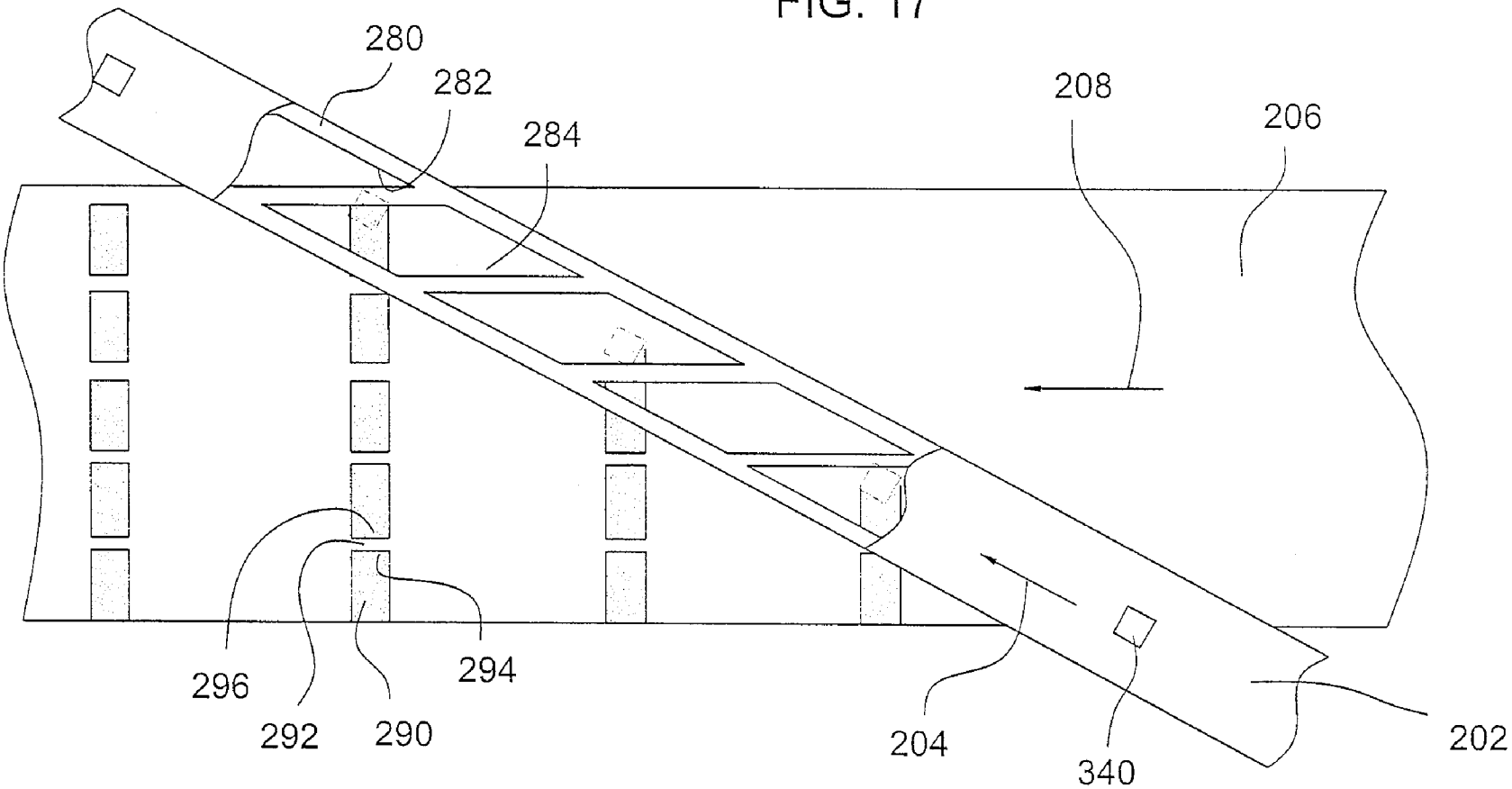
FIG. 17 is a schematic top view showing a moving belt with generally square orifices.
Figure 18:
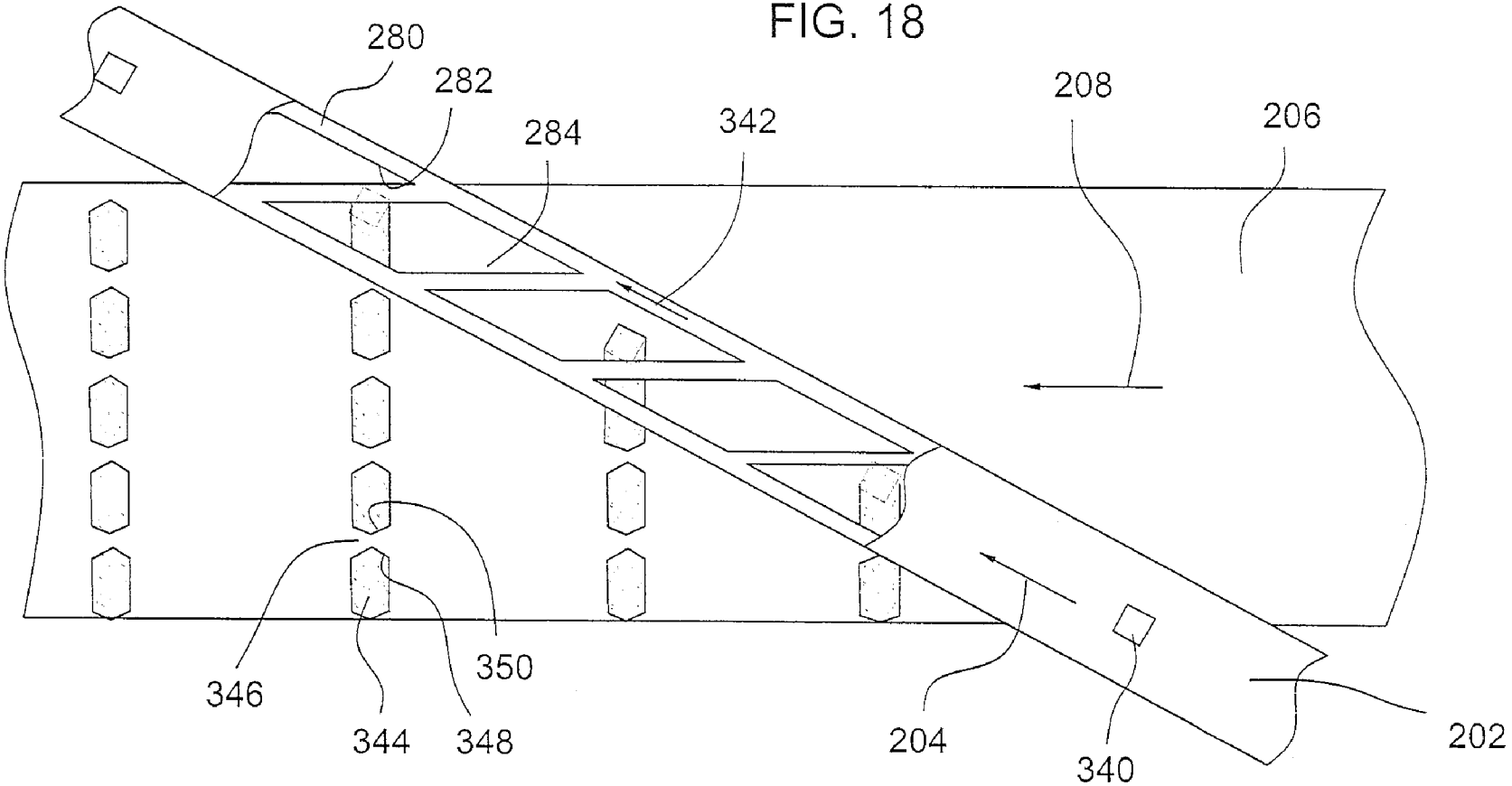
FIG. 18 is a schematic top view, similar to FIG. 17 with a moving belt and a moving base plate.
Figure 19:
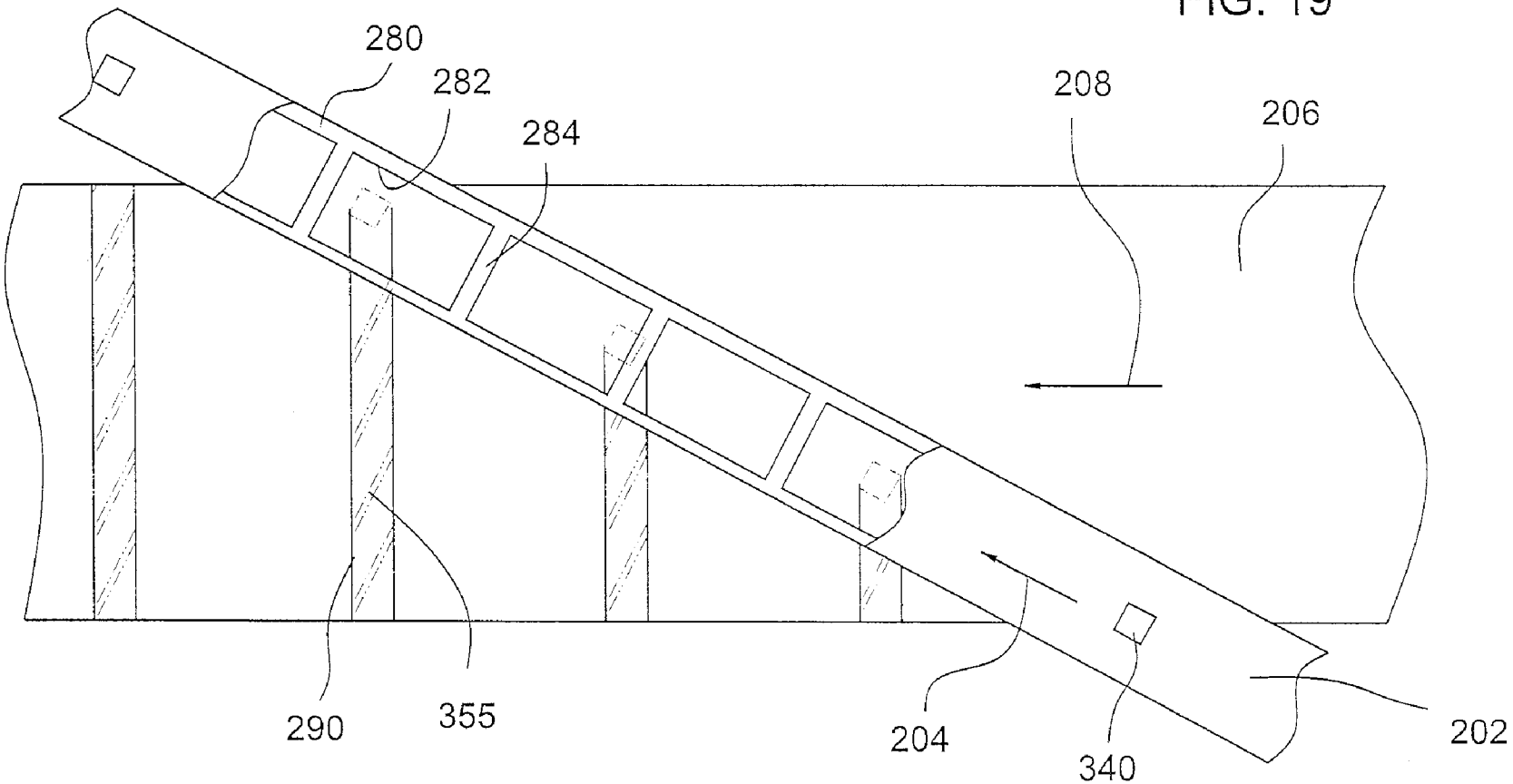
FIG. 19 is a schematic view, similar to FIG. 15, with generally square orifices.

The shape of the window 330 may also be a parallelogram in which the parallel sides of the window 330 are arranged to be substantially cross-web with respect to the web 206 (see FIG. 16). The orifices 340 (see FIG. 17) of the belt 202 may be generally circular, non-circular, generally polygonal, generally quadrilateral, or generally square. An embodiment having square orifices with sides parallel to the direction 204 of movement of the template belt 202 is also envisioned. The template belt or member 280 may have a speed relative to the underlying web which is less than the speed of the belt 202 (see FIG. 18) such that the gap spaces 346 are bounded by opposed inverted points. The template belt or member 280 may be fixed, having substantially rectangular windows 282 along with a belt having substantially square orifices (see FIG. 19).

Figure 20:
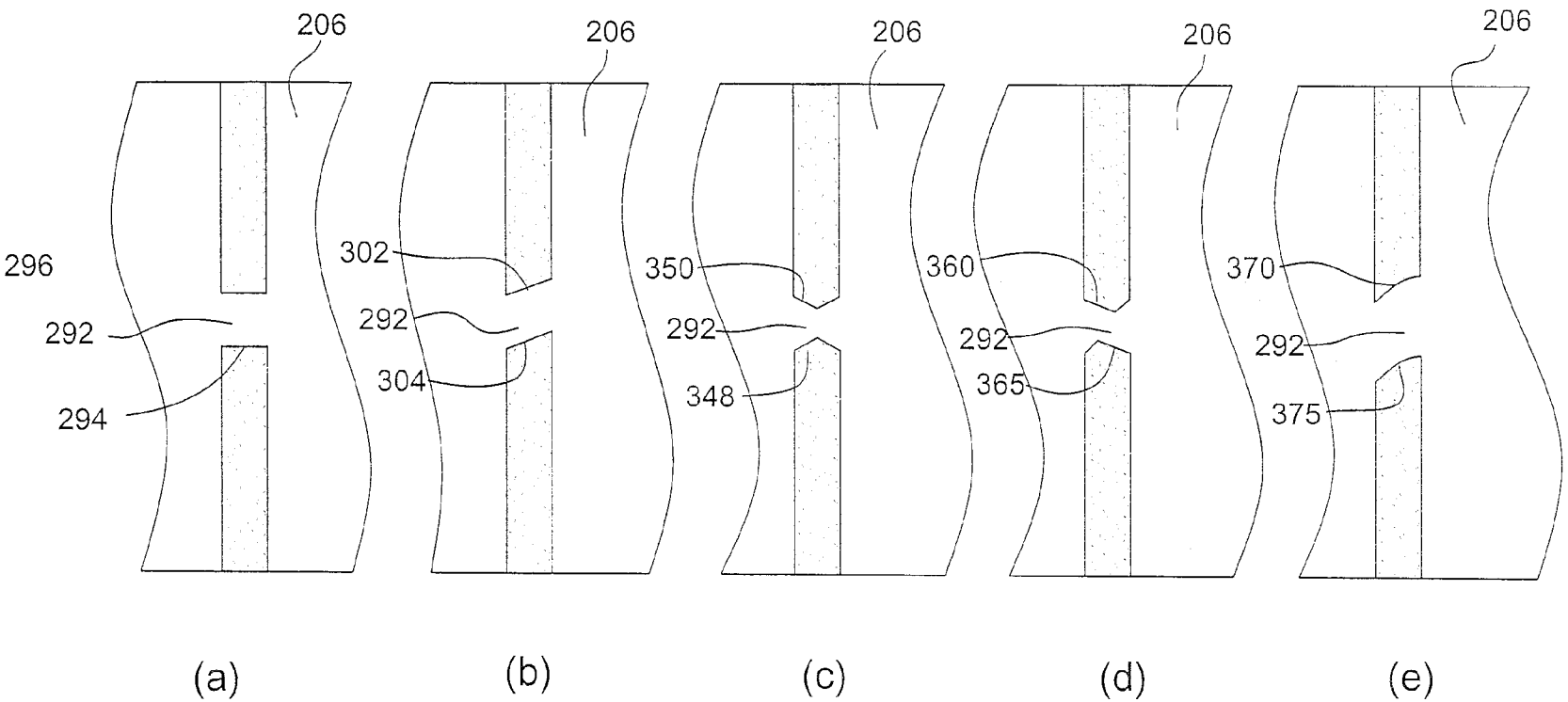
FIG. 20 is a schematic illustration of exemplary band break configurations.

In short, the transverse stripes may have a variety of different gap openings having configurations including sharp edges generally aligned with the longitudinal direction of the web (see FIG. 20(*a*)); inclined edges relative to the longitudinal edges of the web (see FIG. 20(*b*)); symmetrical pointed edges (see FIG. 20(*c*)); asymmetrical pointed edges (see FIG. 20(*d*)); or arcuate edges (see FIG. 20 (*e*)).

Figure 21:
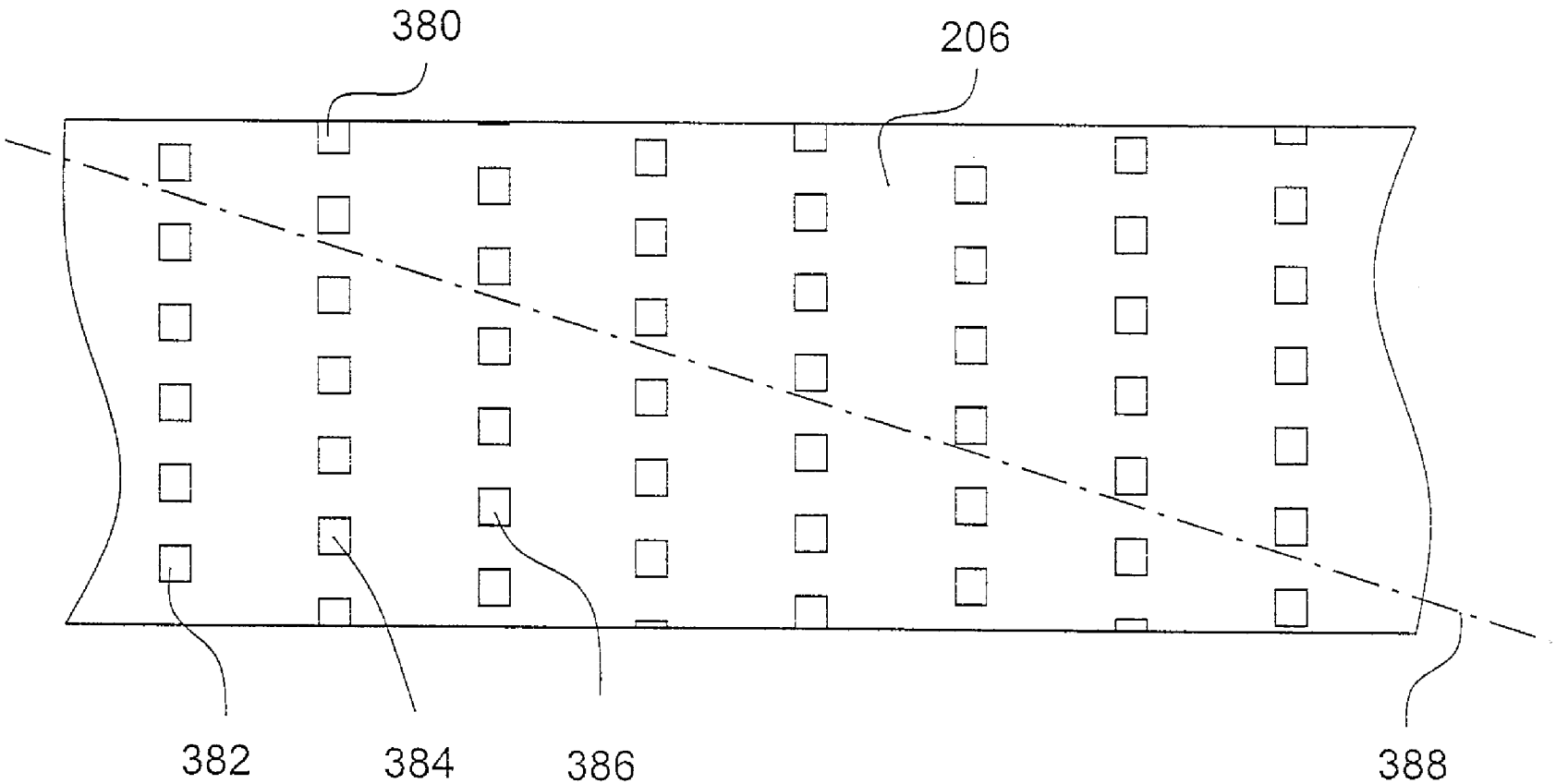
FIG. 21 is a schematic view of a patch-like pattern.

Proportions of the window may also be adjusted such that the web 206 has a plurality of add-on material groups 382, 384, 386 (see FIG. 21) in which individual patches 380 are aligned along an axis 388 inclined relative to an edge of the web 206. In such an embodiment, individual portions or patches 380 may be distributed such that the ratio of (i) cross-web spacing between adjacent patches 380 and (ii) the spacing between adjacent transverse stripes 382, 384, 386 lies in the range of about 0.3 to about 3.0 and more preferably in the range of about 0.6 to about 1.4. To implement a patch configuration in which gap spaces have dimensions comparable to those dimensions of the patches themselves (measured in the cross-web direction), it may be desirable to operate the support member such that it moves in a direction opposite to the movement of the orifice belt (i.e., with a negative speed relative to the speed of the orifice belt).

Figure 22:
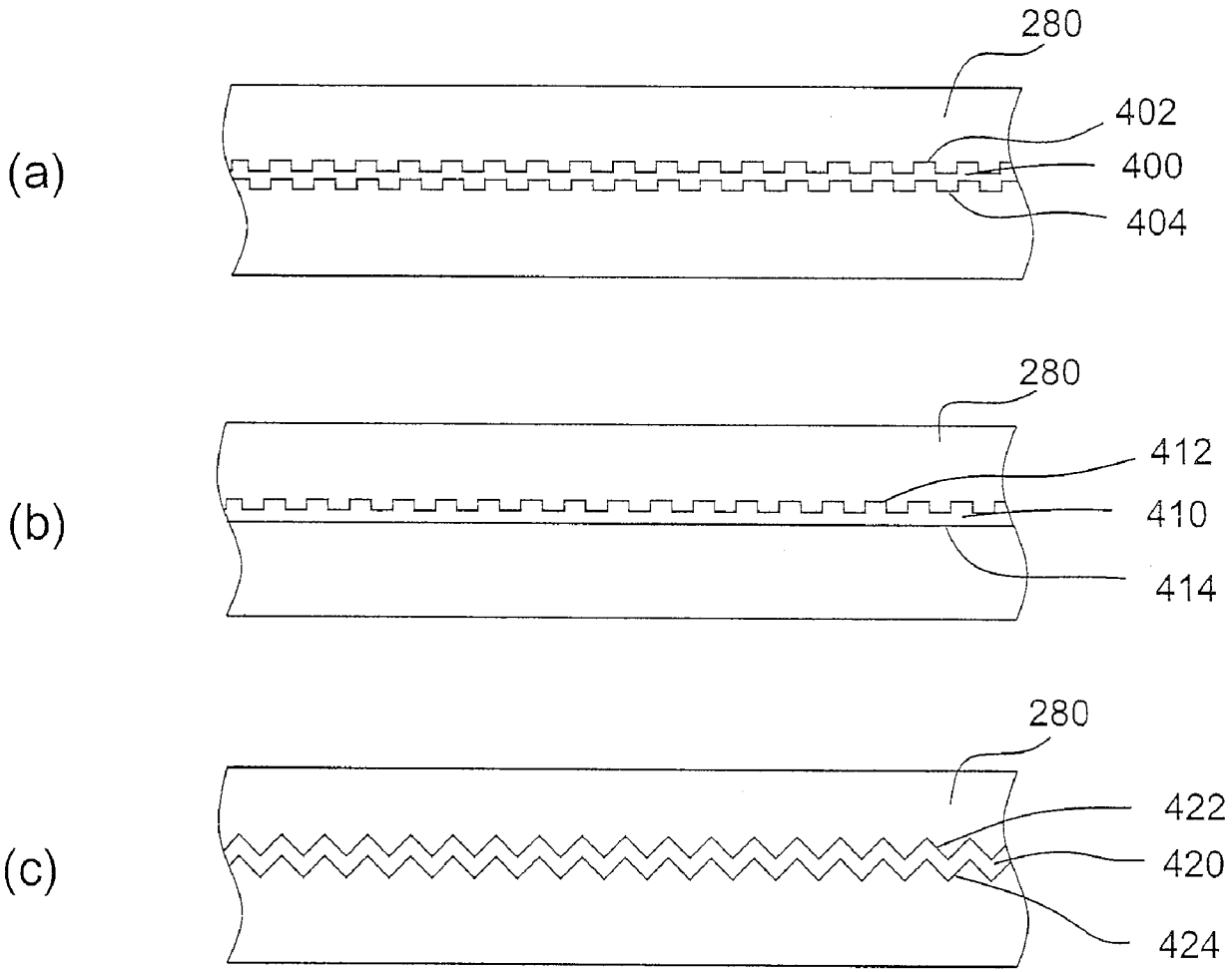
FIG. 22 is a schematic view of crennelated base plate configurations.

Other configurations for the template belt or member 280 are also envisioned where, for example, the base plate defines a longitudinal slot 400 (see FIG. 22(*a*)) defined by undulations or crenellations 402, 404 arranged such that the projections of those features are aligned with one another across the width of the template belt or member 280. In another configuration, the template belt or member 280 (see FIG. 22(*b*)) includes a longitudinal slot 410 defined on one side by a substantially straight edge 414 and defined on the opposite side by an undulating or crenellated edge 412. Yet another embodiment (see FIG. 22(*c*)) of the template belt or member 280 may include a slot 420 defined on each side by a zig-zag edge 422, 424.

Figure 23:
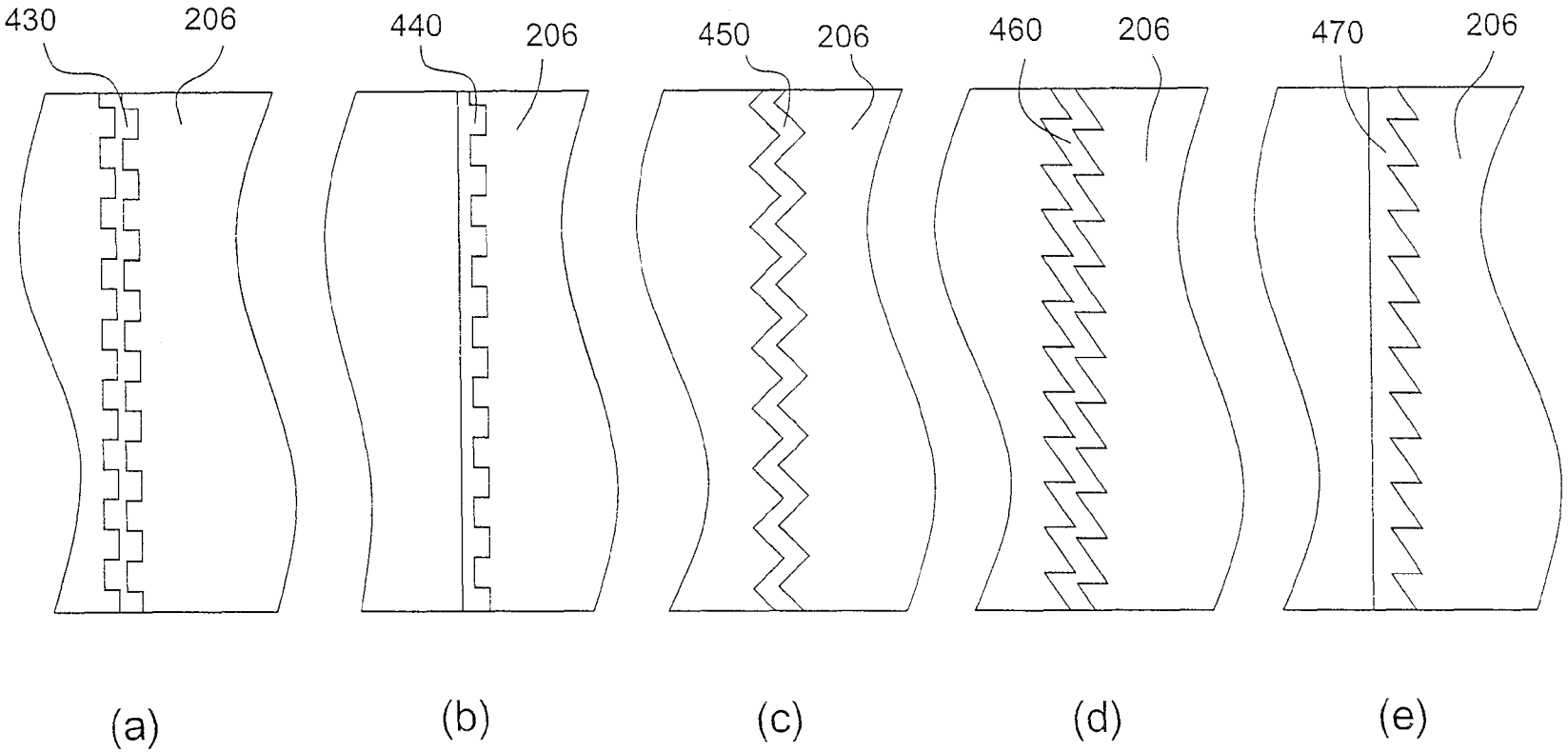
FIG. 23 is a schematic view of crennellated band configurations.

Base plates having the configurations of FIG. 22, for example, may be operated to generate transverse stripes on the base web 206 (see FIG. 23) having undulations or crenellations on one or both sides (see FIGS. 23(*a*) and 23(*b*)), a generally zig-zag shape (see FIG. 23(*c*)), or a generally sawtooth shape on one or both sides (see FIGS. 23(*d*) and 23(*e*)).

Those skilled in the art will also appreciate that an orifice belt 202 having orifice groups 210 (see, e.g., FIGS. 7-11) may also be used with a base plate or window belt of the type described above to provide patterns of transverse stripes or bands on the base web. Such a combination of an orifice band having orifice groups with a window belt may, for example, be useful to generate a pattern in which the resulting stripes exhibit longitudinal spacing (in the longitudinal direction of the base web) as well as gaps in the transverse direction (in the transverse direction of the base web).

It should be recognized that the slurry being deposited by the moving orifice structure has a significant fibrous component. Accordingly, when the slurry is deposited by this system on a moving web, edges of the deposited stripes may not have precise form that would be designed into apparatus. Accordingly, it will also be appreciated by those skilled in the art that precise prediction of the gap opening configurations is complicated by, for example, dynamics of the moving stream emanating from orifices of the moving orifice belt 202, interaction between that moving stream and the cross-pieces of the support bracket, and fluid conditions of the moving stream including without limitation pressure, temperature, viscosity, and composition. Thus, some empirical testing of a desired gap opening configuration may be warranted to fine tune the orifice contour, support member window shape, and operating conditions.

The resulting wrapper paper can be useful in manufacturing cigarettes having controlled, desirable ignition propensity and self-extinction characteristics. For example, the wrapper paper may be designed to provide cigarettes with an ignition propensity of 25% or less as tested in accordance with the American Society of Testing and Materials (ASTM) Standard E2187-04, "Standard Test Method for Measuring the Ignition Strength of Cigarettes", approved Jul. 1, 2004, and published August 2004. That standard provides a measure of the capability of a lit banded-paper cigarette, positioned on a combustible substrate, to continue to smolder. Examples of smoking articles, of cigarettes, which may be fashioned using wrapper paper fabricated in the manner and methods described above, may be found in co-pending, commonly owned U.S. patent application Ser. No. 12/153,783, of Ping Li et al., entitled "Banded Papers, Smoking Articles and Methods", filed May 23, 2008 (published as U.S. Pat. App. Publ. No. 2008-0295854-A1 on Dec. 4, 2008), which is incorporated herein by this reference thereto. Wrapper papers having bands with gaps in the circumferential direction (i.e., the transverse direction of the base web during manufacture of the base web) may be useful to allow additional combustion air during free burn of the smoking article, and to be occluded by a substrate when an ignited smoking article is placed on such a substrate thereby reducing combustion-supporting air and increasing the likelihood that the smoking article will self-extinguish.

In accord with the teachings of this disclosure, smoking articles may be produced using the resulting wrapping paper where the banded regions have a variety of configurations. An advantage of each of the potential configurations results from the fact that the banded regions have the same composition as the underlying base web or base paper. Moreover, the resulting wrapper paper results from the process and does not require a separate printing step to provide the banded regions. Furthermore, the resulting wrapper paper may be fabricated at the linear speed at which the associated paper making machine operates.

Figure 24:
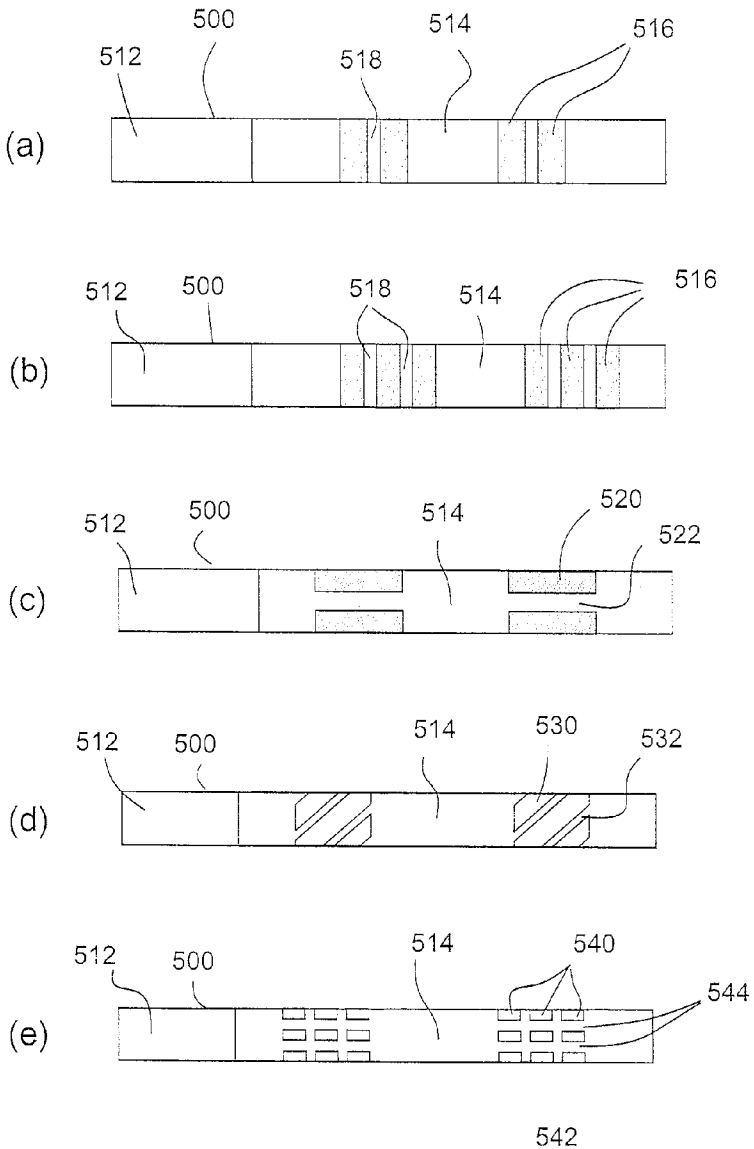
FIG. 24 is a schematic view of several smoking articles using wrapper paper according to this disclosure.
Figure 25:
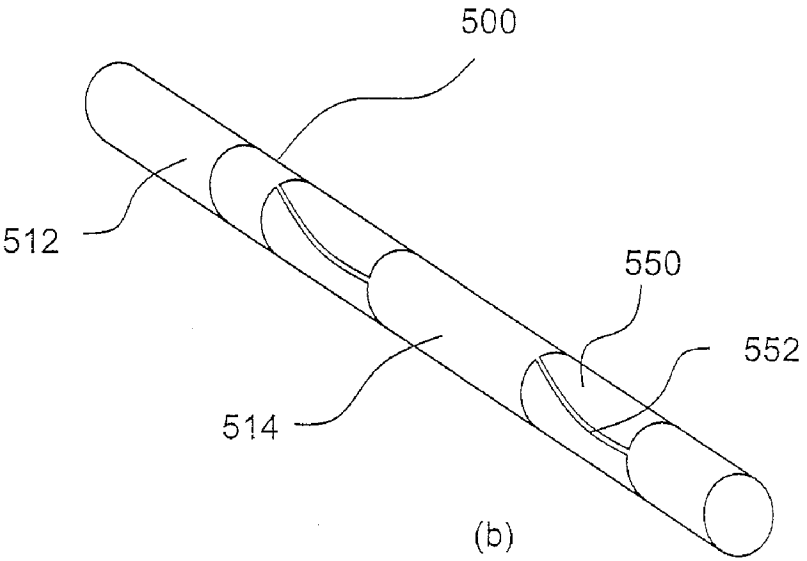
FIG. 25 is a schematic perspective view of several smoking articles according to this disclosure.
Figure 25:
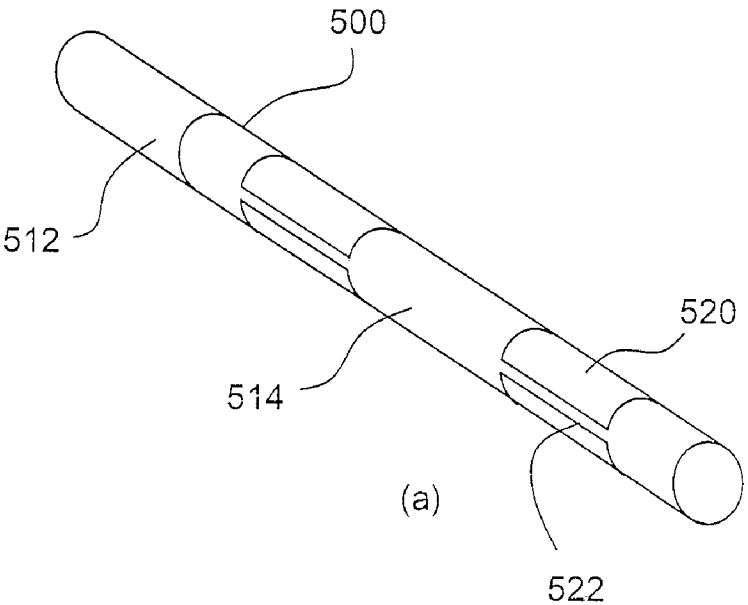

A few of the many possible configurations are illustrated for a smoking article manufactured using the wrapper paper described above. For example, a smoking article 500, may include a conventional filter 512 at one end, and a tobacco rod having a quantity of tobacco surrounded by a wrapper 514. Where the orifice band has orifice groups with pairs of spaced orifices, the smoking article 500 manufactured from the resulting wrapper 514 may have one or more banded regions exhibiting a pair of circumferentially extending bands 516 spaced from one another by a circumferentially extending space or gap 518 (see FIG. 24(*a*)). Where the orifice groups include three spaced orifices, the smoking article 500 manufactured from the resulting wrapper 514 may exhibit banded regions having three circumferentially extending bands 516, with adjacent pairs of the bands 516 being spaced by a circumferentially extending space or gap 518 (see FIG. 24(*b*)).

Where a template belt or member is used between the orifice band and the underlying web (see FIG. 12), the smoking article 500 manufactured from the resulting wrapper 514 may exhibit one or more banded regions 520 having a gap or space 522 extending substantially longitudinally along the smoking article (see FIGS. 24(*c*) and 25(*a*)). Where a template belt or member is used between the orifice band and the underlying web (see FIG. 13), the smoking article 500 manufactured from the resulting wrapper 514 may exhibit one or more banded regions 530 having a gap or space 532 extending both longitudinally along the smoking article and circumferentially around the smoking article (see FIG. 24(*d*)). Where a template belt or member is used between (i) the orifice band having orifice groups with three spaced orifices and (ii) the underlying web (see FIG. 12), the smoking article 500 manufactured from the resulting wrapper 514 may exhibit one or more banded regions 540 having circumferentially extending gaps or spaces 542 as well as longitudinally extending gaps or spaces 544 (see FIG. 24(*e*)). Where the template belt or member and the orifice band are configured to generate banded regions with the contours depicted in FIG. 20 (*e*), the smoking article 500 manufactured from the resulting wrapper may exhibit one or more banded regions 550 having a gap or space with non-linear edges and which wraps around the tobacco rod (see FIG. 25(*b*)). Other combinations and permutations of the orifice band, the template belt or member, and operating speeds of those elements can be selected to generate a multiplicity of configurations for the banded regions of a smoking article.

When the word "generally" is used in this specification in conjunction with a geometric descriptor, it is intended that the geometric descriptor includes not only the precise geometric characteristic but also similar geometric characteristics that would function as an equivalent thereto.

When the word "about" is used in this specification in connection with a numerical value, it is intended that that numerical value have a tolerance of +/−10% of the numerical value stated.

While the invention has been described in detail with reference to specific embodiments thereof, it will be apparent to those skilled in the art that various changes and modifications can be made, and equivalents employed, without departing from the spirit and scope of the invention as defined in the appended claims.

What is claimed is:

1. A method of manufacturing a web having an applied pattern of add-on material, the method comprising the steps of: moving a base web along a first path; preparing a slurry of add-on material; repetitively discharging the slurry of add-on material upon the moving base web by establishing a reservoir of the add-on material across the first path and moving a belt having an orifice group along an endless path, wherein the orifice group includes at least two orifices spaced relative to one another by a distance less than the diameter of one of the two orifices such that the slurry of add-on material being discharged from the orifice group defines a banded region having a least a relative minimum thickness between the leading and trailing edges of the banded region, and said belt moving step including the step of moving said belt along a first portion of said endless path where said at least one orifice group is communicated with said reservoir so as to discharge said slurry of add-on material from said reservoir through said at least one orifice group onto said base web as said at least one orifice group traverses said first path portion.

2. A method of manufacturing a web having an applied pattern of add-on material, the method comprising the steps of: moving a base web along a first path; preparing a slurry of add-on material; repetitively discharging the slurry of add-on material upon the moving base web by establishing a reservoir of the add-on material across the first path and moving a belt having at least one orifice group along an endless path, said belt moving step including the step of moving said belt along a first portion of said endless path where said at least one orifice group is communicated with said reservoir so as to discharge said slurry of add-on material from said reservoir through said at least one orifice group onto said base web as said at least one orifice group traverses said first path portion, wherein the at least one orifice group has at least two generally circular orifice elements spaced from one another by a distance less than the diameter of one of the orifices, the slurry of add-on material entering the at least one orifice group defines a group of spaced stripes, the number of stripes corresponding to the number of orifices.

3. A method of manufacturing a web having an applied pattern of add-on material, the method comprising the steps of: moving a base web along a first path; preparing a slurry of add-on material; repetitively discharging the slurry of add-on material upon the moving base web by establishing a reservoir of the add-on material across the first path and moving a belt having at least one orifice group along an endless path, said belt moving step including the step of moving said belt along a first portion of said endless path where said at least one orifice group is communicated with said reservoir so as to discharge said slurry of add-on material from said reservoir through said at least one orifice group onto said base web as said at least one orifice group traverses said first path portion, wherein the at least one orifice group comprises spaced apart orifice groups, each of the orifice groups comprises at least two intersecting orifices and has a length at least 1.5 times longer than its width and rounded end walls.

4. A method of manufacturing a web having an applied pattern of add-on material, the method comprising the steps of:

moving a base web along a first path;

preparing a slurry of add-on material;

repetitively discharging the slurry of add-on material upon the moving base web by establishing a reservoir of the add-on material across the first path, moving a belt having a plurality of substantially uniformly spaced orifices along an endless path, and positioning a template having a plurality of windows therethrough between the belt and the base web the windows defining a plurality of bars therebetween, wherein the orifices are spaced relative to one another such that the slurry of add-on material being discharged from the orifices defines a plurality of banded regions spaced longitudinally along the base web, and said belt moving step including the step of moving said belt along a first portion of said endless path where at least one orifice has fluid communication with the reservoir so as to discharge the slurry of add-on material from said reservoir the at least one orifice onto said base web as the at least one orifice traverses said first path portion; and wherein the bars of the template periodically interrupt the banded regions transverse to the slurry discharge from the reservoir so as to define a plurality of gaps in the banded regions.

5. The method of claim 4 wherein each orifice moves across the base web with a cross-web speed, including the further step of moving the template in the direction of movement of the belt with a speed less than the cross-web speed.

6. The method of claim 4 including the further step of providing generally circular orifices in the belt.

7. The method of claim 4 including the further step of providing generally quadrilateral orifices in the belt.

8. A method of manufacturing a web having a predetermined applied pattern of add-on material, said pattern comprising a plurality banded regions in a spaced apart relation, each banded region exhibiting a slower burn rate in comparison to areas between adjacent banded regions, each banded region including a leading edge and a trailing edge and a common location of a minimum thickness of add-on material between said leading and a trailing edges, the method comprising the steps of:

moving a base web along a first path;

repetitively establishing said spaced apart relation of said banded regions by discharging a slurry of add-on material upon the moving base web by communicating a reservoir of the add-on material with orifices of a moving endless belt operative across said first path, while maintaining said plurality orifices in discrete groups of orifices spaced from one another by a distance less than the diameter of one of the orifices along said belt, said spacing and said belt moving at a speed such that said discharging occurs consistently with said spaced apart relation of said banded regions;

repetitively establishing said common location of a minimum thickness of add-on material between said leading and trailing edges by maintaining a common spatial relation amongst orifices of each discrete group of orifices.

9. The method of claim 8, wherein maintaining the spatial relation includes providing each discrete group of orifices with a common first orifice and a common second orifice and spacing said at first and second orifices of each discrete group relative to one another by a common distance and according to a common mutual orientation.

10. The method of claim 9, wherein said spacing is less than the diameter of one of said first and second orifices.

* * * * *